US007237866B2

(12) United States Patent
Yamazaki et al.

(10) Patent No.: US 7,237,866 B2
(45) Date of Patent: Jul. 3, 2007

(54) IMAGE PRINTING USING PRINT QUALITY ENHANCING INK

(75) Inventors: Satoshi Yamazaki, Nagano-ken (JP); Yuko Yamamoto, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 207 days.

(21) Appl. No.: 11/033,710

(22) Filed: Jan. 13, 2005

(65) Prior Publication Data

US 2005/0122368 A1 Jun. 9, 2005

Related U.S. Application Data

(62) Division of application No. 10/410,608, filed on Apr. 10, 2003, now Pat. No. 6,863,374.

(30) Foreign Application Priority Data

Apr. 16, 2002 (JP) ..... 2002-112888
Aug. 30, 2002 (JP) ..... 2002-252771

(51) Int. Cl.
*B41J 2/015* (2006.01)

(52) U.S. Cl. ..... 347/21; 347/95

(58) Field of Classification Search ..... None
See application file for complete search history.

(56) References Cited

U.S. PATENT DOCUMENTS 5,864,350 A 1/1999 Shioya et al.
6,102,537 A * 8/2000 Kato et al. ..... 347/101
6,158,856 A * 12/2000 Sato et al. ..... 347/101
6,412,934 B1 * 7/2002 Moriyama et al. ..... 347/96

FOREIGN PATENT DOCUMENTS

| | | | |
|---|---|---|---|
| CN | 1126661 | A | 7/1996 |
| EP | 0 703 087 | A2 | 3/1996 |
| EP | 0 845 356 | A2 | 6/1998 |
| JP | 63-312841 | A | 12/1988 |
| JP | 64-44756 | A | 2/1989 |
| JP | 8-39795 | | 2/1996 |
| JP | 8-216392 | A | 8/1996 |
| JP | 2001-205800 | A | 7/2001 |
| JP | 2001-270217 | | 10/2001 |
| JP | 2001-277488 | | 10/2001 |
| JP | 2001-301145 | A | 10/2001 |
| JP | 2002-307755 | | 10/2002 |

OTHER PUBLICATIONS

Japanese Abstract No. 01114450, dated May 8, 1989.

* cited by examiner

*Primary Examiner*—Thinh Nguyen
(74) *Attorney, Agent, or Firm*—Sughrue Mion, PLLC

(57) ABSTRACT

Image quality is improved by adjusting the ejection amount of quality enhancing ink based on the ejection amount of colored ink containing colorant. When a relatively high gross printing medium is used, the quality enhancing ink is ejected in an image area where virtually no colored ink is ejected, thereby improving unevenness in gloss within the print image. When a relatively low gross printing medium is used, on the other hand, the quality enhancing ink is ejected in an image area where the colored ink is ejected on virtually all pixels, thereby improving unevenness in color within the print image. The relationship between the ejection amounts of the quality enhancing ink and the colored ink may be modified by the user.

31 Claims, 35 Drawing Sheets

EXEMPLARY ARRANGEMENT OF
QUALITY ENHANCING INK DOTS

Fig.21

202 (202a, 202b)

| R | G | B | C | M | Y | K | CL |
|---|---|---|---|---|---|---|---|
| 0 | 0 | 0 | 0 | 0 | 0 | 255 | × |
| 0 | 0 | 16 | 3 | 3 | 0 | 250 | × |
| 0 | 0 | 32 | 4 | 6 | 0 | 245 | × |
| | ⋮ | | | ⋮ | | | ⋮ |
| 0 | 0 | 255 | 251 | 255 | 0 | 0 | × |
| 0 | 16 | 0 | 3 | 0 | 3 | 250 | × |
| 0 | 16 | 16 | 3 | 3 | 3 | 240 | × |
| | ⋮ | | | ⋮ | | | ⋮ |
| 255 | 176 | 144 | 0 | 80 | 111 | 0 | × |
| 255 | 192 | 144 | 0 | 63 | 111 | 0 | × |
| 255 | 208 | 144 | 0 | 49 | 111 | 0 | × |
| 255 | 224 | 144 | 0 | 30 | 111 | 0 | × |
| | ⋮ | | | ⋮ | | | ⋮ |
| 255 | 255 | 255 | 0 | 0 | 0 | 0 | × |

$17^3$ 個

PRINT QUALITY-ENHANCING INK CL

P2

| CYAN INK C | 5% | 10% | 15% | 20% | 25% | 30% | 35% | 40% | |
|---|---|---|---|---|---|---|---|---|---|
| 0% | 0,5 | 10,0 | 15,0 | 20,0 | 25,0 | 30,0 | 35,0 | 40,0 | P4 |
| 10% | 5,10 | 10,10 | 15,10 | 20,10 | 25,10 | 30,10 | 35,10 | 40,10 | P5 |
| 20% | 5,20 | 10,20 | 15,20 | 20,20 | 25,20 | 30,20 | 35,20 | 40,20 | P6 |
| 30% | 5,30 | 10,30 | 15,30 | 20,30 | 25,30 | 30,30 | 35,30 | 40,30 | P7 |
| 40% | 5,40 | 10,40 | 15,40 | 20,40 | 25,40 | 30,40 | 35,40 | 40,40 | P8 |
| 50% | 5,50 | 10,50 | 15,50 | 20,50 | 25,50 | 30,50 | 35,50 | 40,50 | P9 |
| 60% | 5,60 | 10,60 | 15,60 | 20,60 | 25,60 | 30,60 | 35,60 | 40,60 | P10 |
| 70% | 5,70 | 10,70 | 15,70 | 20,70 | 25,70 | 30,70 | 35,70 | 40,70 | P11 |
| 80% | 5,80 | 10,80 | 15,80 | 20,80 | 25,80 | 30,80 | 35,80 | 40,80 | P12 |
| 90% | 5,90 | 10,90 | 15,90 | 20,90 | 25,90 | 30,90 | 35,90 | 40,90 | P13 |

IMAGE PRINTING USING PRINT QUALITY ENHANCING INK

This is a divisional of application Ser. No. 10/410,608 filed Apr. 10, 2003 now U.S. Pat. No. 6,863,374; the disclosure of which is incorporated herein by reference.

BACKGROUND OF THE INVENTION

1. Field of the Invention

The present invention relates to a printing device for printing images by ejecting a plurality of inks onto printing media.

2. Description of the Related Art

In recent years, ink jet printers have come to enjoy widespread use as image printing devices. Users may select desired print media from among a variety of available types for use in ink jet printers. Such print media include, for example, "glossy" paper having relatively high gloss, "plain" paper having relatively low gloss, matte paper, and so on.

The amount of ink that is ejected onto printing media is determined by the image data that is to be printed. Greater amounts of ink are ejected in areas of low brightness, and lower amounts of ink are ejected in areas of higher brightness.

When an image is printed on a printing medium of relatively high gloss, the gloss tends to be more intense in areas where more ink has been ejected. For example, when images of human figures are printed against a white background, the gloss is higher in areas with human figures, which is where greater amounts of ink are ejected, and the gloss is lower in the background area, where less ink is ejected. A resulting problem is that a person viewing the image experiences unpleasant impression of different levels of gloss in different areas of the same image.

When the image is printed on a printing medium of relatively low gloss, on the other hand, the ink tends to be absorbed by the printing medium. As a result, less ink colorant remains on the surface of the printing medium, and areas which are supposed to be covered by the ink on the printing medium do not develop on the surface, making it difficult to attain the desired coloring. The unevenness of coloring is especially noticeable in areas where large amounts of ink have been ejected, such as areas in which ink has been ejected on virtually all of the pixels. When images of human figures are printed against a white background, for example, the unevenness of coloring will occur in the area of the human figures containing a greater amount of ink, causing graininess in the image.

In short, conventional printing with ordinary inks sometimes cannot attain satisfactory image quality.

SUMMARY OF THE INVENTION

An object of the present invention is to improve image quality of a print.

According to the present invention, there is provided a printing device for printing images by ejecting ink onto a printing medium. The printing device comprises: a print head configured to eject colored ink containing colorant, and quality enhancing ink for enhancing image quality of a print image; and an adjuster configured to adjust an ejection amount of the quality enhancing ink as a function of an ejection amount of the colored ink on the print image such that the ejection amount of the quality enhancing ink has a non-zero varying value in at least a part of an entire range of the ejection amount of the colored ink.

The present invention is also directed to a printing device for printing images by ejecting ink onto a printing medium, the printing device being capable of utilizing a first printing medium with relatively high gloss or a second printing medium with relatively low gloss. The printing device comprises: a print head configured to eject colored ink containing colorant, and quality enhancing ink for enhancing image quality of a print image; and an adjuster configured to adjust an ejection amount of the quality enhancing ink as a function of an ejection amount of the colored ink on the print image. The adjuster has: a first quality adjusting mode, applicable to the first printing medium, in which a first ejection amount of the quality enhancing ink in an image area where the colored ink is ejected on virtually all pixels is set lower than a second ejection amount of the quality enhancing ink in an image area where virtually no colored ink is ejected, thereby improving unevenness in gloss within the print image; and a second quality adjusting mode, applicable to the second printing medium, in which a third ejection amount of the quality enhancing ink in an image area where the colored ink is ejected on virtually all pixels is set higher than a fourth ejection amount of the quality enhancing ink in an image area where virtually no colored ink is ejected, thereby improving unevenness of coloring within the print image.

The present invention is further directed to a printing control device for generating print data from image data, the print data representing an ink ejection state at each pixel of a print image, the ink ejection state including an ejection amount of colored ink containing colorant and an ejection amount of quality enhancing ink for improving image quality of the print image. The printing control device comprises: ejection characteristic designation receiving means for receiving an ejection characteristic designation that specifies ejection characteristics of the quality enhancing ink; ejection characteristics modifying means for modifying the ejection amount of the quality enhancing ink on the basis of the received ejection characteristic designation; and print data generating means for generating print data representing the ink ejection state including the ejection amount of the colored ink and the modified ejection amount of the quality enhancing ink at each pixel of the print image.

Another aspect of the present invention pertains to a printing device for printing images by ejecting ink onto a printing area of a printing medium, comprising: a print head configured to eject colored ink containing colorant, and quality enhancing ink for enhancing image quality of a print image; and an ink amount determining unit configured to determining an ejection amount of the quality enhancing ink such that ink dots of the quality enhancing ink are dispersed in a substantially uniform pattern within at least a part of the printing area where the ejection amount of the colored ink is not zero.

The present invention can be realized in a variety of embodiments, such as printing methods and printing devices, printing control methods and printing control devices, computer programs for executing the functions of such methods and devices, computer readable media on which such computer programs are stored, and data signals embedded in carrier waves including computer programs.

These and other objects, features, aspects, and advantages of the present invention will become more apparent from the following detailed description of the preferred embodiments with the accompanying drawings.

BRIEF DESCRIPTION OF THE DRAWINGS

FIG. 21 shows a table arrangement diagram illustrating an exemplary arrangement for first and second color conversion tables.

DESCRIPTION OF THE PREFERRED EMBODIMENT

Embodiments of the present invention are described in the following order.

A. Structure of the Device

B. First Embodiment

C. Second Embodiment

D. Variants

A. Structure of the Device

Figure 1:
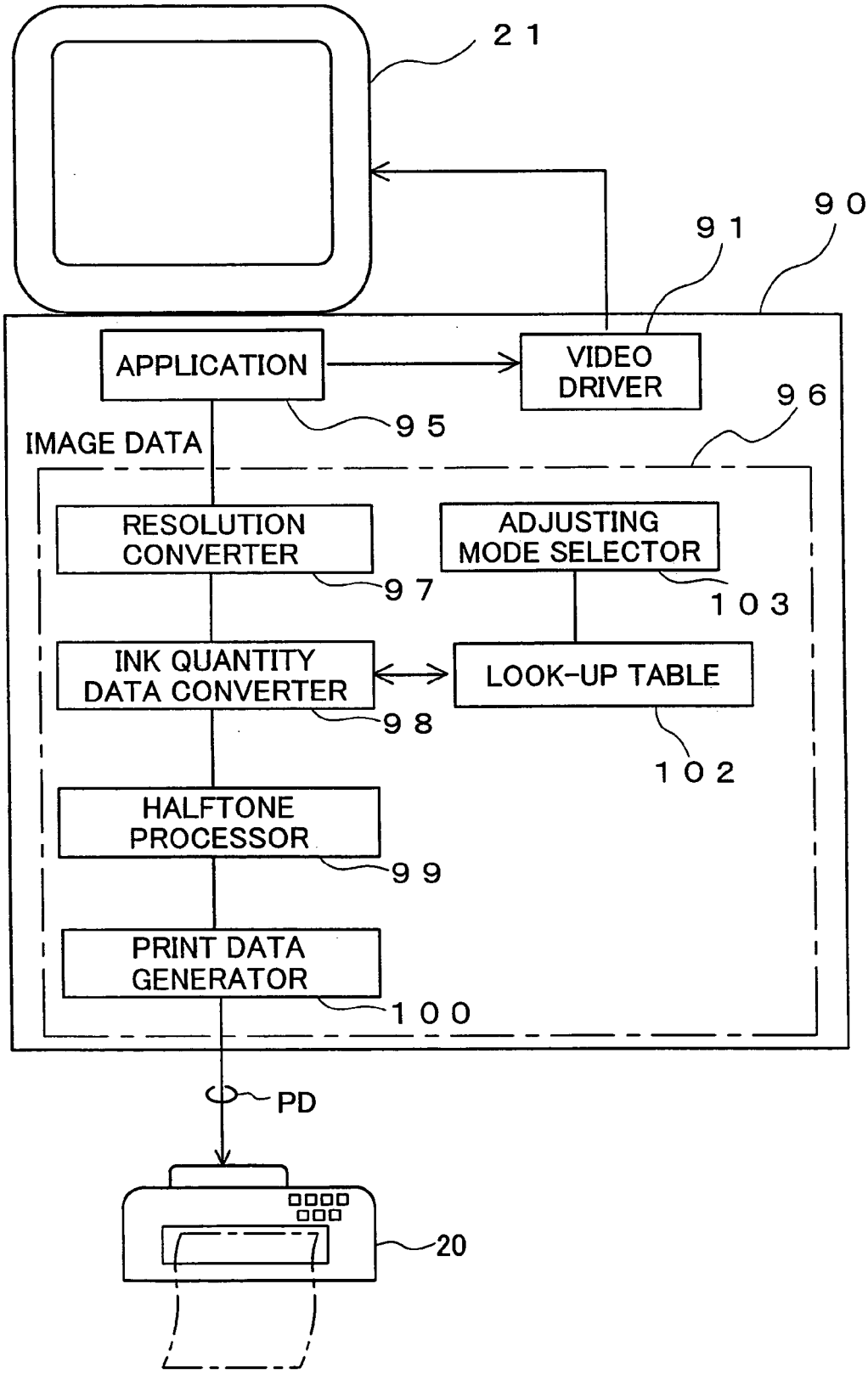
FIG. 1 is a block diagram showing the structure of a printing system embodying the present invention.

FIG. 1 is a block diagram illustrating the structure of the printing system in a first embodiment of the invention. The printing system comprises a computer 90 serving as a printer control device, and a printer 20 serving as a printing unit. The printer 20 and computer 90 can be referred to as the "printing device" in the broad sense.

The computer 90 runs an application program 95 on a predetermined operating system. This operating system includes a video driver 91 and a printer driver 96 which serves as a quality adjusting unit or a ink amount determination unit. Print data PD is output from the application program 95 via these drivers to the printer 20. The application program 95 which retouches images or the like runs the desired process on a targeted image and displays the image on a CRT 21 via the video driver 91.

When the application program 95 issues a print command, the printer driver 96 receives image data from the application program 95, and converts this into print data PD to be supplied to the printer 20. In the example illustrated in FIG. 1, the printer driver 96 includes a resolution converter 97, an ink quantity data converter 98, a halftone processor 99, a print data generator 100, a look-up table 102, and a quality adjusting mode selector 103.

The resolution converter 97 has the function of converting the resolution (that is, the number of pixels per unit of length) of the color image data produced by the application program 95 into the print resolution. The resolution-converted image data also consists of the three RGB color components. The ink quantity data converter 98 refers to the look-up table 102 to convert the RGB image data (first image data) for each pixel into multilevel ink quantity data (second image data) representing the amounts of the plurality of inks used by the printer 20.

The quality adjusting mode selector 103 enables a user to select one quality adjusting mode from a plurality of available quality adjusting modes for the printer 20. When only one quality adjusting mode is available, the process using the quality adjusting mode selector 103 and the mode selector 103 itself may be omitted.

The look-up tables 102 are prepared according to the quality adjusting modes selectable by the quality adjusting mode selector 103. The ink quantity data converter 98 refers to the look-up table corresponding to the selected quality adjusting mode. The types of quality adjusting modes, the ink quantity data converter 98, and the look-up tables 102 are described later in detail.

The ink quantity data has, for example, 256 levels. The halftone processor 99 performs a halftone process to generate halftone image data from the ink quantity data. The halftone image data is arranged by the print data generator 100 in the sequence in which the data will be transmitted to the printer 20, and is output as the final print data PD. The print data PD includes raster data indicating the dot recording status during each main scan, and data indicating the sub-scan feed amount.

The printer driver 96 corresponds to a computer program for performing the function of generating print data PD. The printer driver 96 is provided in computer-readable form recorded on recording media. Typical recording media include floppy disks; CD-ROM; magneto-optical disks; IC cards; ROM cartridges; punch cards; print imprinted with symbols such as bar codes; computer internal storage devices (such as RAM, ROM or other types of memory) and external storage devices; and various other computer-readable media.

Figure 2:
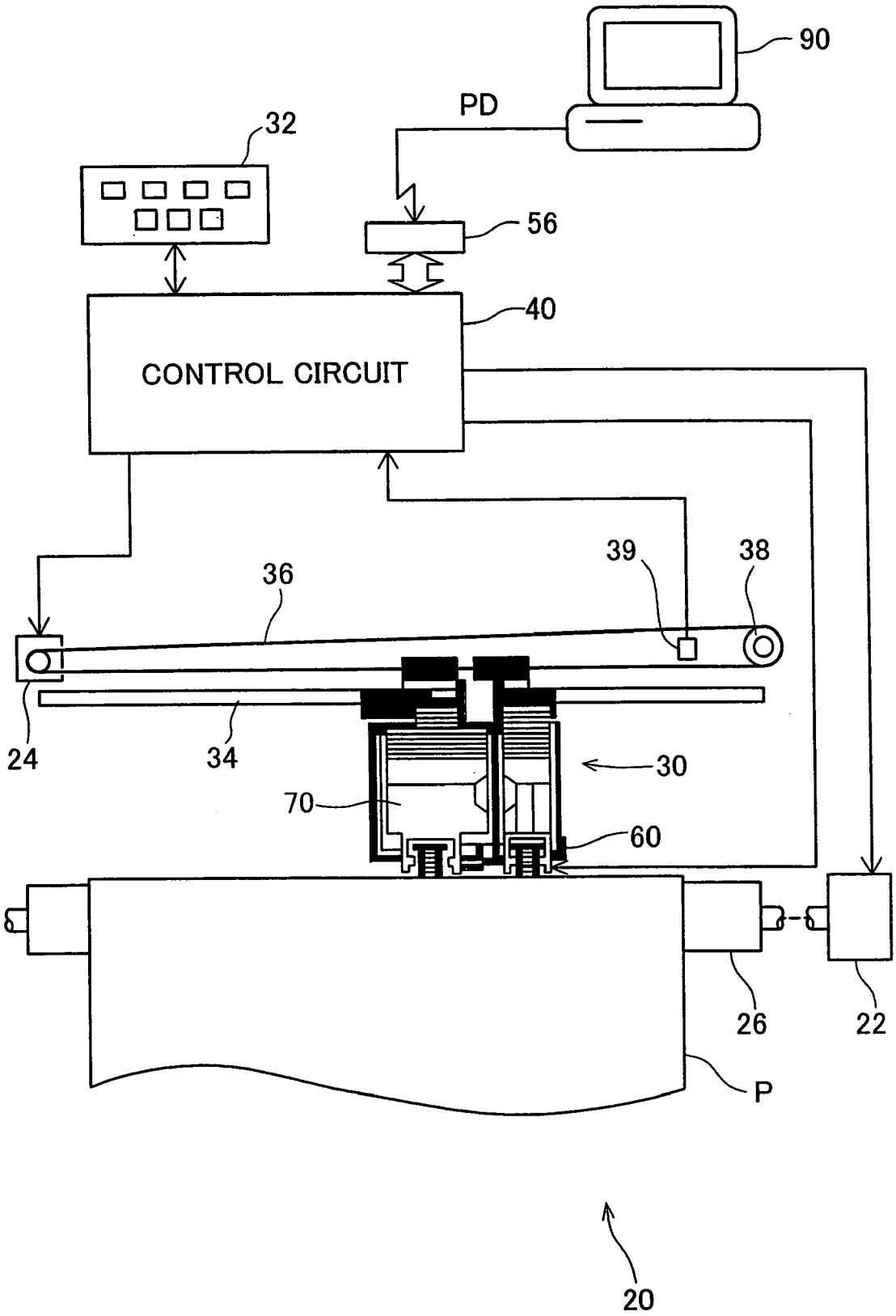
FIG. 2 illustrates the structure of a printer.

FIG. 2 is a schematic structural diagram of the printer 20. The printer 20 comprises a sub-scan feed mechanism for advancing printing paper P in the sub-scanning direction by means of a paper feed motor 22; a main scan feed mechanism for reciprocating a carriage 30 in the axial direction of a platen 26 (main scanning direction) by means of a carriage motor 24; a head drive mechanism for driving a print head unit 60 mounted on a carriage 30 and controlling ink discharge and dot formation; and a control circuit 40 for exchanging signals with the paper feed motor 22, carriage motor 24, print head unit 60, and a control panel 32. The control circuit 40 is connected to the computer 90 through a connector 56.

The sub-scan feed mechanism for advancing print paper P comprises a gear train (not shown) for transmitting the rotation of the paper feed motor 22 to the platen 26 and paper feed rollers (not shown). The main scan feed mechanism for reciprocating the carriage 30 comprises a slide rail 34 which is suspended parallel to the axis of the platen 26 and slidably retains the carriage 30; a pulley 38, with an endless drive belt 36 suspended in tension between it and the carriage motor 24; and a position sensor 39 for sensing the original position of the carriage 30.

Figure 3:
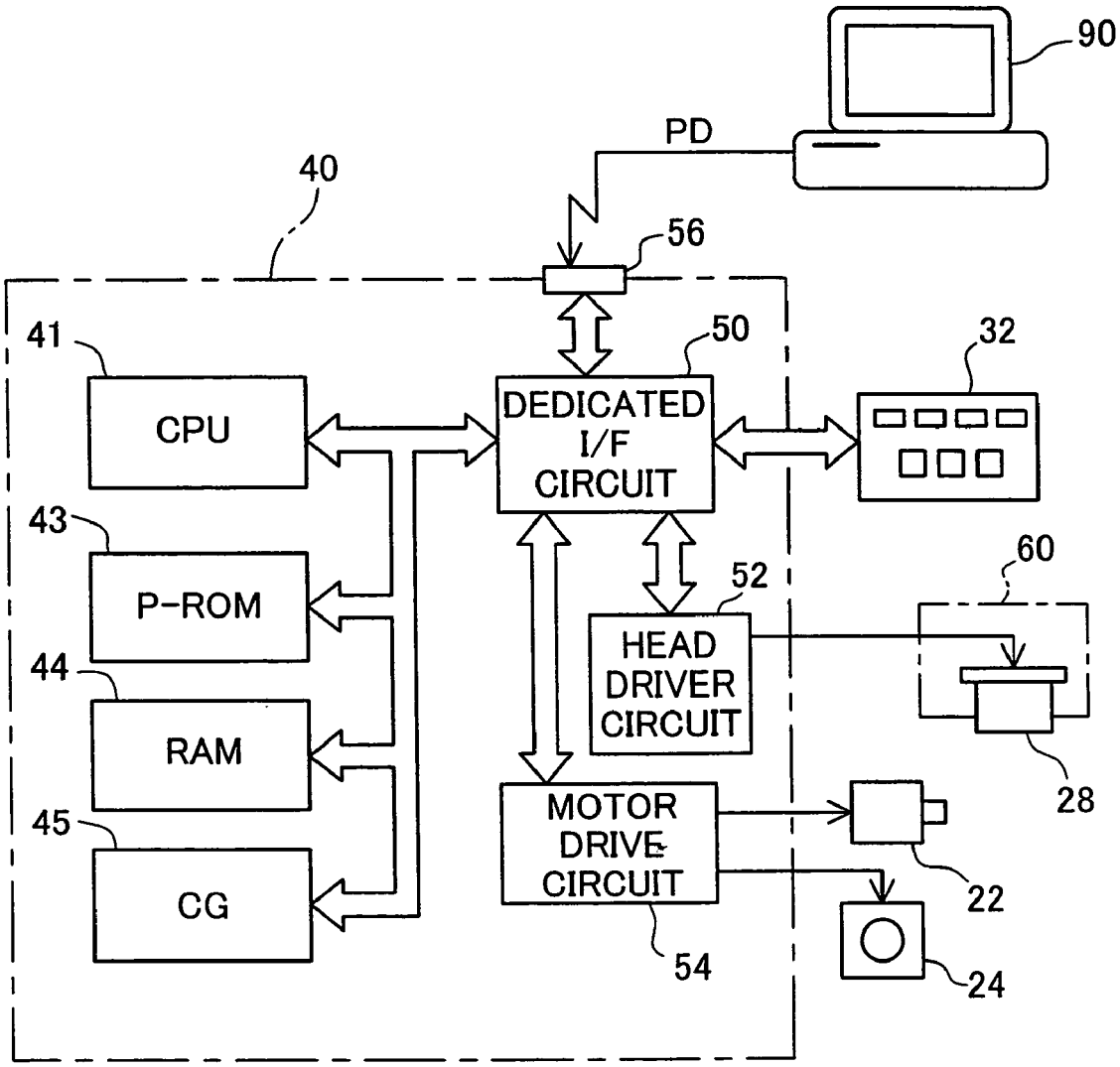
FIG. 3 is a block diagram depicting the structure of the control circuit 40 in the printer 20.

FIG. 3 is a block diagram illustrating the structure of the printer 20, focusing on the control circuit 40. The control circuit 40 is designed as an arithmetic/logic circuit comprising a CPU 41, programmable ROM (PROM) 43, RAM 44, and a character generator (CG) 45 for storing character dot matrices. The control circuit 40 additionally comprises an I/F circuit 50 to interface with external motors, etc.; a head driver circuit 52, connected to the I/F circuit 50, for driving the print head unit 60 to eject ink; and a motor drive circuit 54 for driving the paper feed motor 22 and carriage motor 24. The I/F circuit 50 includes a parallel interface circuit, and can receive print data PD supplied by the computer 90 through the connector 56. The I/F circuit 50 is not limited to a parallel interface circuit, and can be determined in consideration of the ease of connection to the computer 90, such as a universal serial bus interface circuit. The printer 20 executes printing in accordance with the print data PD. The RAM 44 functions as a buffer memory for temporarily storing raster data.

The print head unit 60 has a print head 28, and accommodates ink cartridges for plural types of ink. The print head unit 60 is detachably installed as a unit on the printer 20. That is, the print head unit 60 is replaced when replacing the print head 28. Nozzles for ejecting ink are disposed on the bottom face of the print head 28.

The printer 20 having the hardware configuration described above reciprocates the carriage 30 by means of the carriage motor 24 while advancing the printer paper P by means of the paper feed motor 22, simultaneously driving the piezo-electric elements of the print head 28 to eject ink droplets, thereby forming ink dots to produce a print image on the printer paper P.

Figure 4:
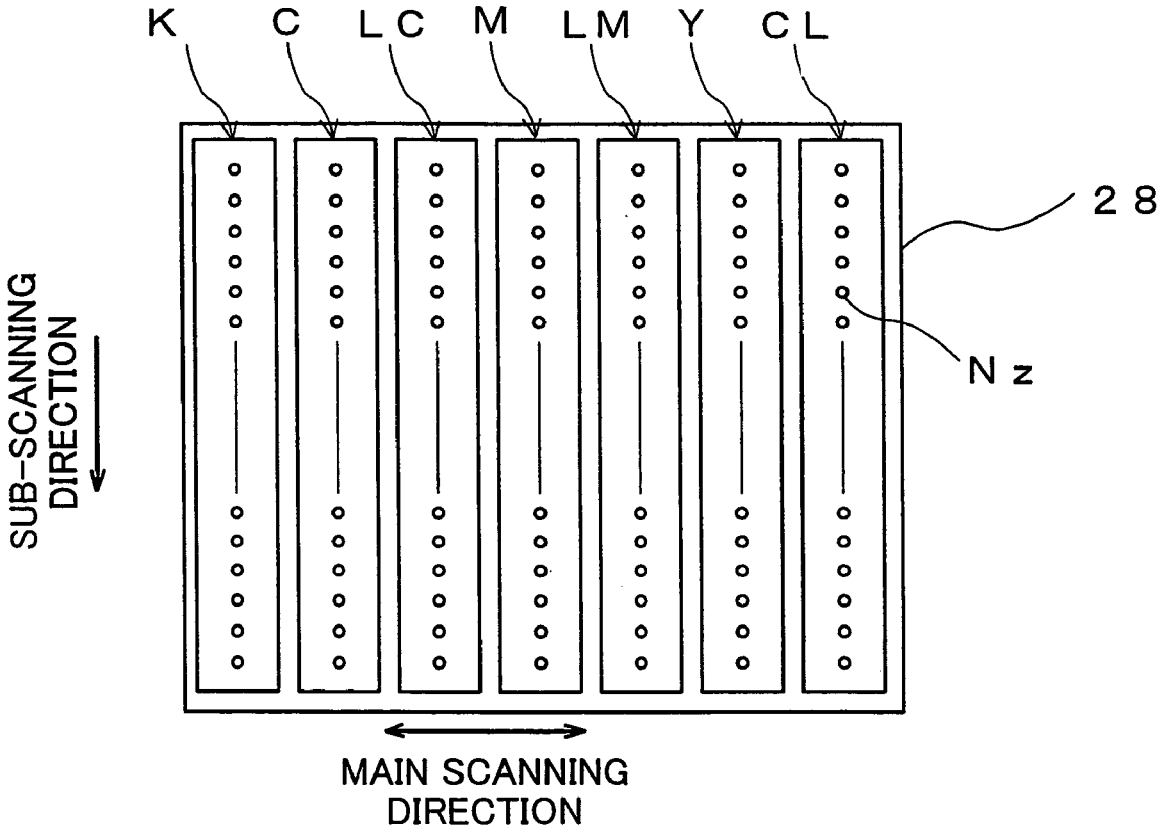
FIG. 4 shows an arrangement of nozzles Nz on the bottom face of a print head 28.

FIG. 4 illustrates an arrangement of nozzles Nz on the bottom face of the print head 28. The print head 28 is provided with a group of nozzles for ejecting black ink K, cyan ink C, light cyan ink LC, magenta ink M, light magenta ink LM, yellow ink Y, and quality enhancing ink CL. Inks other than the quality enhancing ink CL are not limited to the six inks K, C, LC, M, LM and Y. Any ink can be selected as befits the desired print image quality. For example, only the four inks K, C, M, and Y may be used, or only the black ink K may be used in the printer 20. Various other inks such as dark yellow ink having lower brightness than yellow ink Y, gray ink having lower density than black ink K, blue ink, red ink, green ink, and the like may also be used.

The quality enhancing ink CL is preferably ink that has a level of gloss similar to that of the other inks, and that is colorless and transparent so as to enhance the color development of the other inks. The composition of the quality enhancing ink CL is disclosed, for example, in JP 8-60059A, the disclosure of which is hereby incorporated by reference for all purposes. This allows the print image quality to be enhanced without readjusting the amounts of the other inks. Additionally, the use of an ink that improves water resistance and light-fastness can improve the water resistance and light-fastness of the print image. In this case, the water resistance and light-fastness of the printing medium can be improved by using a first quality adjusting mode in which a greater quantity of enhancing ink is ejected onto areas where lower amounts of colored ink have been ejected. The water resistance and light-fastness can also be improved in the areas where ink has been ejected by using a second quality adjusting mode in which a greater quantity of enhancing ink is ejected onto areas where greater amounts of colored ink have been ejected.

Figure 5A:
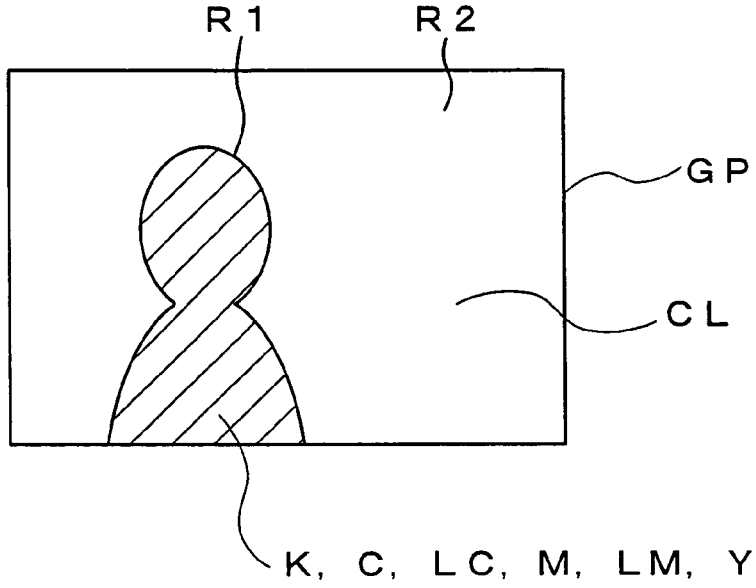
FIGS. 5(*a*) and 5(*b*) show the outline of first and second quality adjusting modes.
Figure 5B:
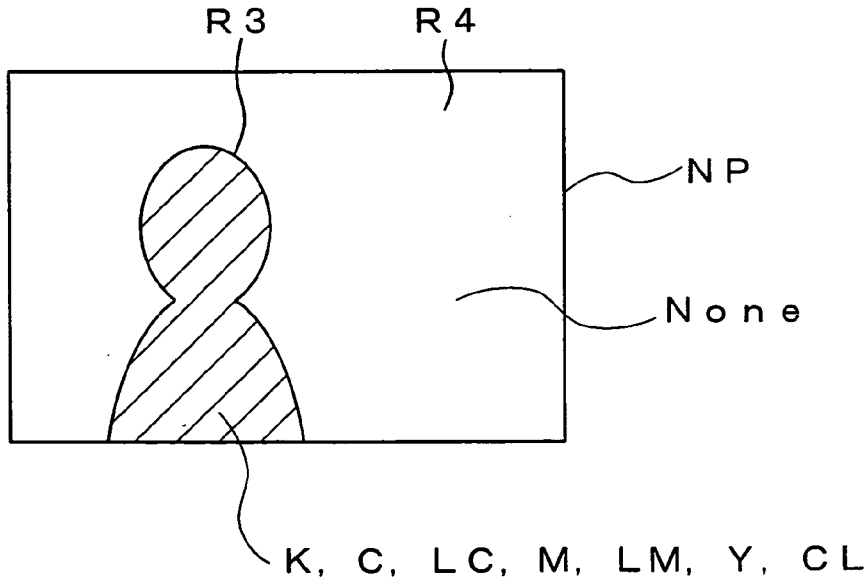

FIGS. 5(*a*) and 5(*b*) illustrate the outline of two quality adjusting modes in the example. The exemplary print includes a human figure. against a white background. In FIG. 5(*a*) illustrates the first quality adjusting mode applicable to cases where images are printed on glossy paper GP, and FIG. 5(*b*) illustrates the second quality adjusting mode applicable to cases where images are printed on non-glossy paper NP. The first and second quality adjusting modes are also referred to as first and second paper modes, respectively. One of the adjusting modes is automatically selected by the printer driver 96 when a user instructs the quality adjusting mode selector 103 to select plain paper or glossy paper on the user set-up window (not shown) of the printer driver 96.

In the first quality adjusting mode illustrated in FIG. 5(*a*), one or more of the inks K, C, LC, M, LM, and Y (referred to as colored inks) other than the quality enhancing ink CL are ejected to reproduce the tones of a human figure. in the area R1. Because the background area R2 is a white background, no colored ink is ejected there. The quality enhancing ink CL is ejected onto the background area R2 where no colored ink is ejected, and very little amount of quality enhancing ink CL is ejected in the human figure. area R1 where colored inks are ejected. When no enhancing ink is used, the gloss in the background area R2 is lower than that of the human figure. area R1 because no ink is ejected in the background area. However, in the first quality adjusting mode, the background gloss is increased because the quality enhancing ink CL is ejected onto the background area R2. As a result, the difference in gloss between the human figure. area R1 and the background area R2 can be minimized to improve unevenness of gloss. Furthermore, since very little amount of quality enhancing ink CL is ejected on the human figure. area R1, the printing medium will not wrinkle or take a long time to dry, and the quality enhancing ink CL can be conserved.

The amount of quality enhancing ink CL is preferably determined according to the total amount of colored inks at each image position. This will further reduce unevenness of local gloss in the image.

In the second quality adjusting mode illustrated in FIG. 5(*b*), on the other hand, colored inks are ejected to reproduce the tones of a human figure. in the human figure. area R3. Because the background area R4 is a white background, no colored ink is ejected there. The quality enhancing ink CL is also ejected on the human figure. area R3 where the colored inks are ejected, but very little amount of quality enhancing ink CL is ejected on the background area R4 where no colored inks are ejected. When no enhancing ink is used, the colored ink ejected onto the human figure. area R3 is absorbed by the printing medium, resulting in unevenness of coloring. However, in the second adjusting mode, irregular color development in the human figure. area R3 can be reduced because the quality enhancing ink CL is ejected on the human figure. area R3 where the colored inks are ejected. The quality enhancing ink CL can be conserved in the background area R4 where very little enhancing ink is ejected.

The amount of enhancing ink CL is preferably determined according to the total amount of colored inks. This will further reduce unevenness of coloring in the image.

B. First Embodiment

B1. Example 1 of First Quality Adjusting Mode

Figure 6A:
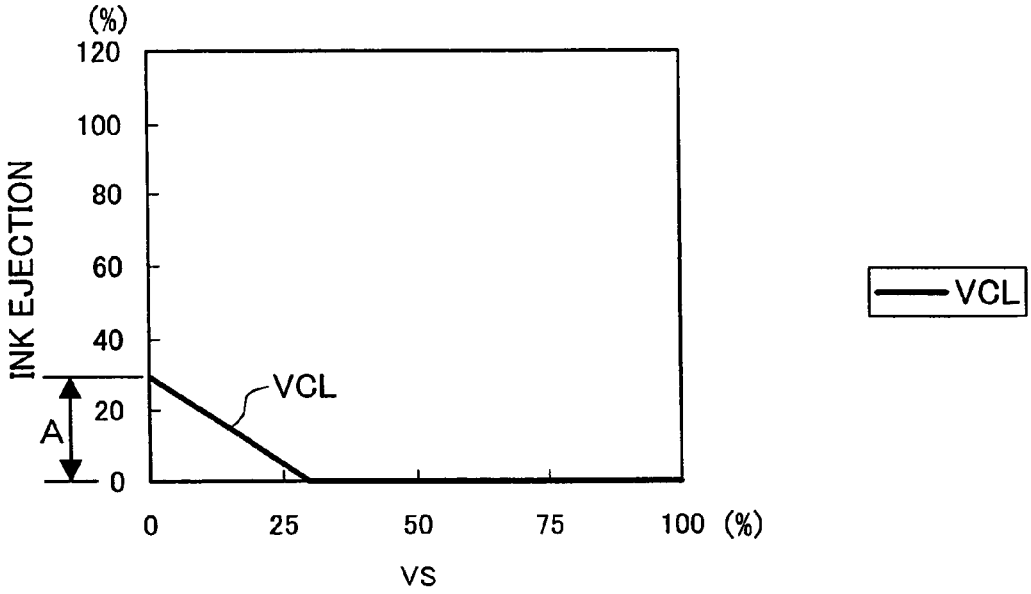
FIGS. 6(*a*) and 6(*b*) show the relationship between the amount of colored ink and the amount of enhancing ink in Example 1 of the first quality adjusting mode.
Figure 6B:
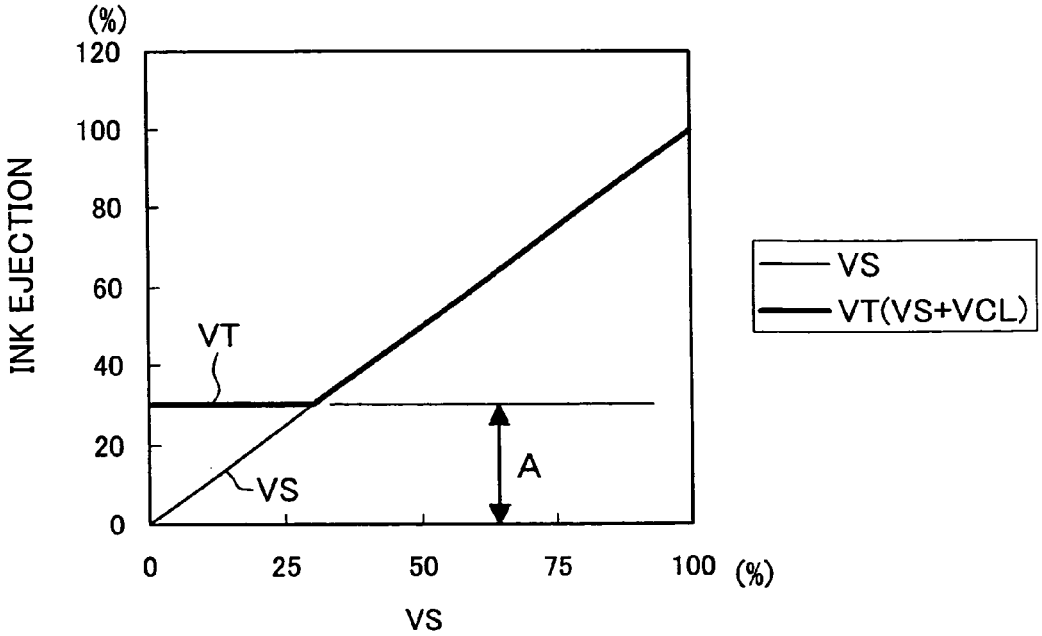

FIG. 6(*a*) shows the relationship between the discharged amount of colored ink VS and the discharged amount of quality enhancing ink VCL, and FIG. 6(*b*) shows the relationship between the discharged amount of colored ink VS and the total discharged amount of colored inks and quality enhancing ink VT (=VS+VCL). The horizontal axis represents the discharged amount of colored inks VS, and the vertical axis represents the discharged amount of ink indicated by the legends.

The ink amount is given as a percentage, where 100% represents the discharge of any ink on all pixels. When it is possible to form dots of different size in a single pixel area, the actual ink amounts discharged should be also accounted for. The amount of discharged colored inks VS is the total amount for various colored inks. As such, when several different types of colored inks are ejected in the same pixel position, the amount of discharged ink VS or VT will be greater than 100%. When gloss varies by ink, the total ink amount may be calculated by weighting each ink amount with a different coefficient. Alternatively, the colored ink amount VS may be defined as a maximum value among the discharge amount of the colored inks.

The discharged amount of quality enhancing ink VCL is set so that a VCL value for the VS value of about 0% is greater than a VCL value for the VS value of about 100%. Gloss in areas with a lower colored ink amount VS can thus be increased by the quality enhancing ink CL to reduce the difference in gloss with areas with a greater colored ink amount VS. The amount of enhancing ink VCL can be reduced in areas with a greater colored ink amount VS, thereby ensuring that no more than the desirable amount of enhancing ink CL is discharged. It is thus possible to prevent the printing medium from wrinkling, to prevent the discharged ink from taking a long time to dry, and to conserve the quality enhancing ink CL. Furthermore, in Example 1, the enhancing ink amount VCL is set so that the colored ink amount VT is at least a first predetermined level A, which is not 0, regardless of VS. That is, the enhancing ink amount VCL is set so that the total amount of all discharged ink VT (=VS+VCL) in all areas of the print image is at least the first predetermined value A. As a result, gloss can be maintained at or above a certain predetermined level in all areas of the print image, thus avoiding conspicuous areas of low gloss. In the example in FIGS. 6(*a*) and 6(*b*), the first predetermined value A is 30%, but the value of A can be determined depending on the type of ink used an the type of print medium.

It should be noted that the term "discharge amount of ink" or "ejection amount of ink" includes 0%, meaning no ejection, in this specification.

The ink quantity data converter 98 (FIG. 1) converts image RGB data (first image data) to multilevel data (second image data) representing the amounts of colored inks, while referred to a selected look-up table 102 corresponding to the quality adjusting mode selected by the quality adjusting mode selector 103 from among the available look-up tables 102. The look-up table 102 is a table storing the gray scale levels of the available inks for the combination of RGB levels. This table can be referenced to determine the ink quantity gray scale level of the quality enhancing ink CL as well as those of the colored inks according to the three RGB levels. In this way, data can be converted by referencing the look-up table 102 to accomplish rapid, better quality printing. In this case, the RGB and ink quantity gray scales each has 256 levels, with values between 0 and 255. The RGB gray levels and ink quantity gray levels are not limited to 256. Establishing more gray scale levels, such as 512, can result in even higher quality printing, and a lower number of gray scale levels, such as 128 levels, can reduce the size of the recording medium needed to record the look-up tables. The first image data is not limited to image data consisting of the three RGB color components. It is also possible to use image data expressed in various other color coordinate systems such as the L*a*b* color coordinate system or XYZ color coordinate system as the first image data.

The look-up tables 102 are prepared in advance corresponding to the available quality adjusting modes for the printer 20. For example, when the quality adjusting mode in Example 1 of the first quality adjusting mode is available, the look-up table is prepared to reflect the relationship between the total amount of colored inks and that of the enhancing ink such as that shown in FIG. 6(*a*). When the first quality adjusting mode is selected using the quality adjusting mode selector 103, uneven gloss can be improved by selecting and referencing the above look-up table. When an ordinary mode which does not involve the use of quality enhancing ink is available, a look-up table is prepared in which there is no enhancing ink-related data or the discharged amount of enhancing ink is 0. It is also possible to employ a look-up table suitable for the first quality adjusting mode while activating a controller (not shown) to stop ejection of the quality enhancing ink.

B2. Example 2 of First Quality Adjusting Mode

Figure 7A:
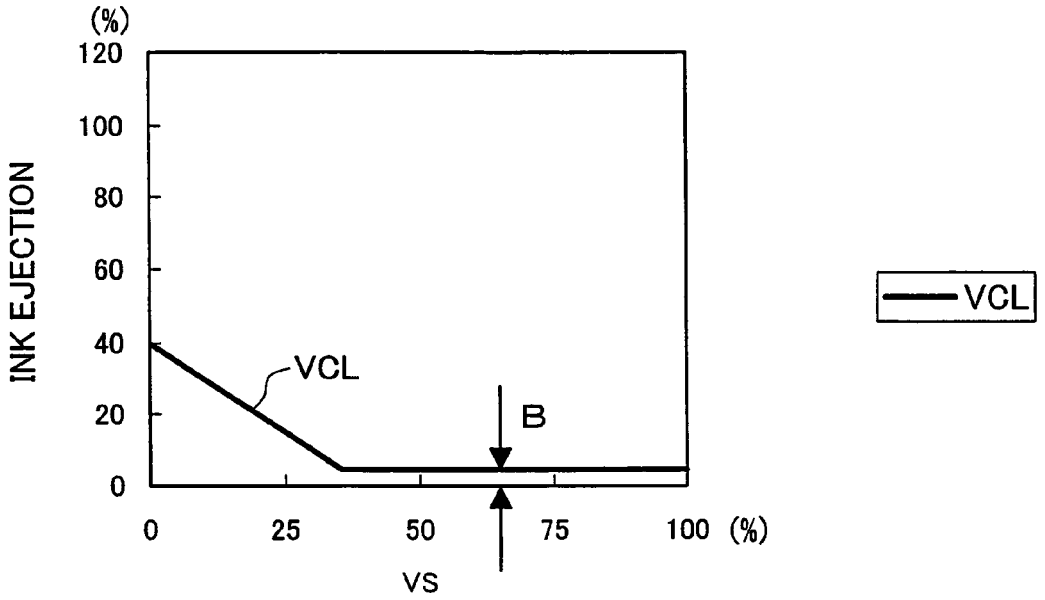
FIGS. 7(*a*) and 7(*b*) show the relationship between the amount of colored ink and the amount of enhancing ink in Example 2 of the first quality adjusting mode.
Figure 7B:
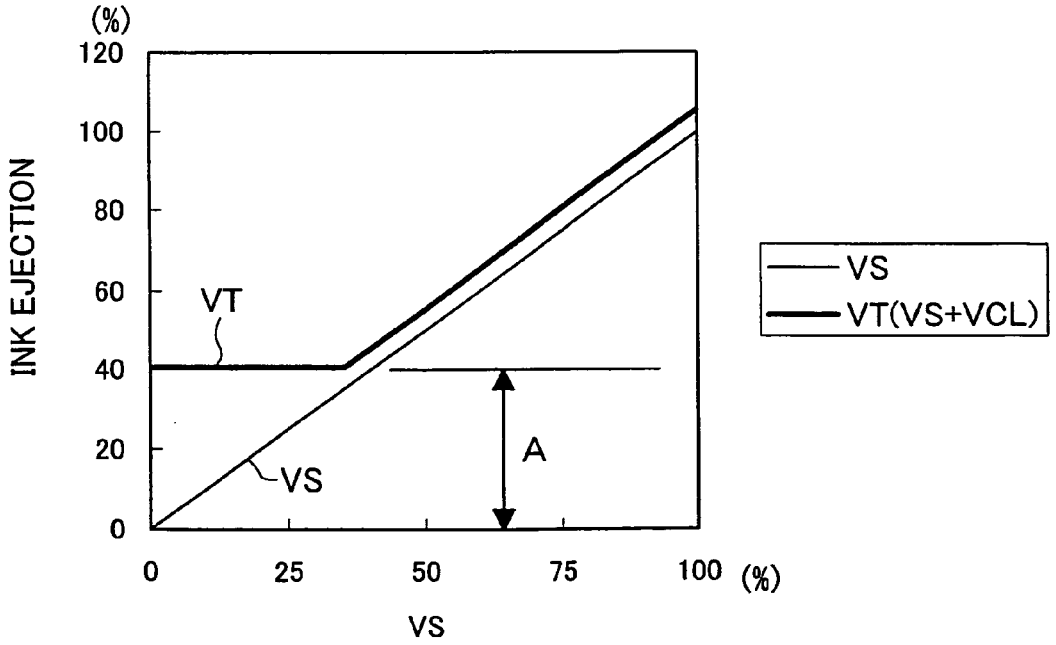

FIGS. 7(*a*) and 7(*b*) show the relationship between the discharged amount of colored inks VS and the discharged amount of enhancing ink VCL in Example 2 of the first quality adjusting mode.

The enhancing ink amount VCL is set so that the total ink amount VT is at least a first predetermined non-zero value A. In areas where the colored ink amount VS is greater than the first predetermined value A, the enhancing ink amount VCL is set to at least a second predetermined value B which is not 0. That is, the total ink amount VT ejected in the entire area of the print image is at least the first predetermined value A, and the enhancing ink amount VCL ejected in the entire area of the print image is at least the second predetermined value B. As a result, differences in gloss can be minimized by the discharge of quality enhancing ink CL in the entire area of the print image when the gloss of the quality enhancing ink CL is different from the gloss of the colored ink. In the example in FIGS. 7(*a*) and 7(*b*), the first predetermined value A is 40%, and the second predetermined value B is 5%, but these values A and B can be determined according to the type of inks and the type of printing medium.

B3. Example 3 of First Quality Adjusting Mode

Figure 8A:
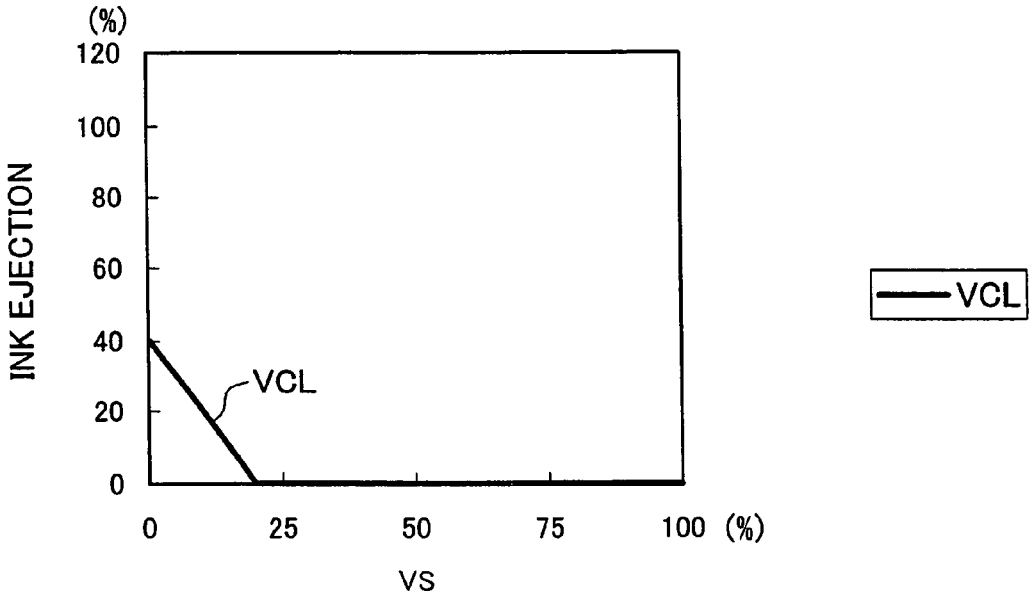
FIGS. 8(*a*) and 8(*b*) show the relationship between the amount of colored ink and the amount of enhancing ink in Example 3 of the first quality adjusting mode.
Figure 8B:
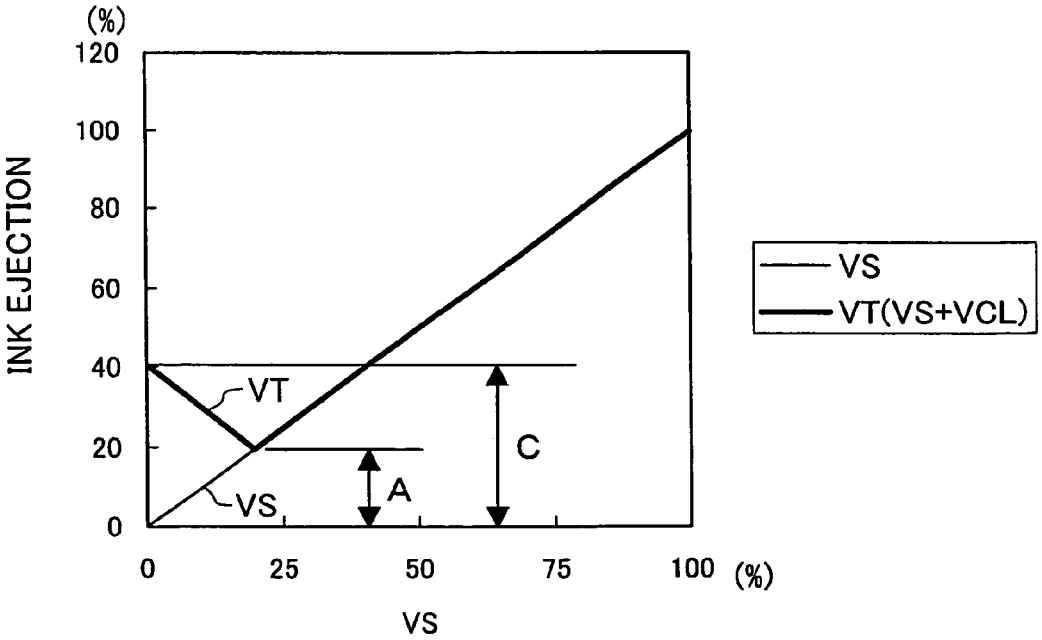

FIGS. 8(*a*) and 8(*b*) show the relationship between the discharged amount of colored inks VS and the discharged amount of enhancing ink VCL in Example 3 of the first quality adjusting mode.

The enhancing ink amount VCL is set so that the total ink amount VT is at least a first predetermined non-zero value A. In areas where the colored ink amount VS is about 0, the enhancing ink amount VCL is set so that the total ink amount VT is at least a first predetermined non-zero value A and not more than a third predetermined non-zero value C. The third predetermined value C is greater than the first predetermined value A. In areas where the colored ink amount VS is low, particularly in areas where the colored ink amount VS is about 0, the gloss of the print image may be predominated by the gloss of the printing medium when the quality enhancing ink CL is not used. When the printing medium gloss is substantially low, the difference in gloss might be sometimes not sufficiently small even when the quality enhancing ink CL has been discharged in an amount corresponding to the first predetermined value A in areas where the colored ink amount VS is about 0%. In such cases, the enhancing ink amount VCL is set so that the total ink amount VT is at least the first predetermined value A and not more than the third predetermined value C in areas where the colored ink amount VS is low, particularly areas where VS is about 0%, thus minimizing the difference in gloss. In the example in FIGS. 8(*a*) and 8(*b*), the first predetermine value A is 20%, and the third predetermined value C is 40%, but these values A and C can be determined according to the type of inks and the type of printing medium.

B4. Example 4 of First Quality Adjusting Mode

Figure 9A:
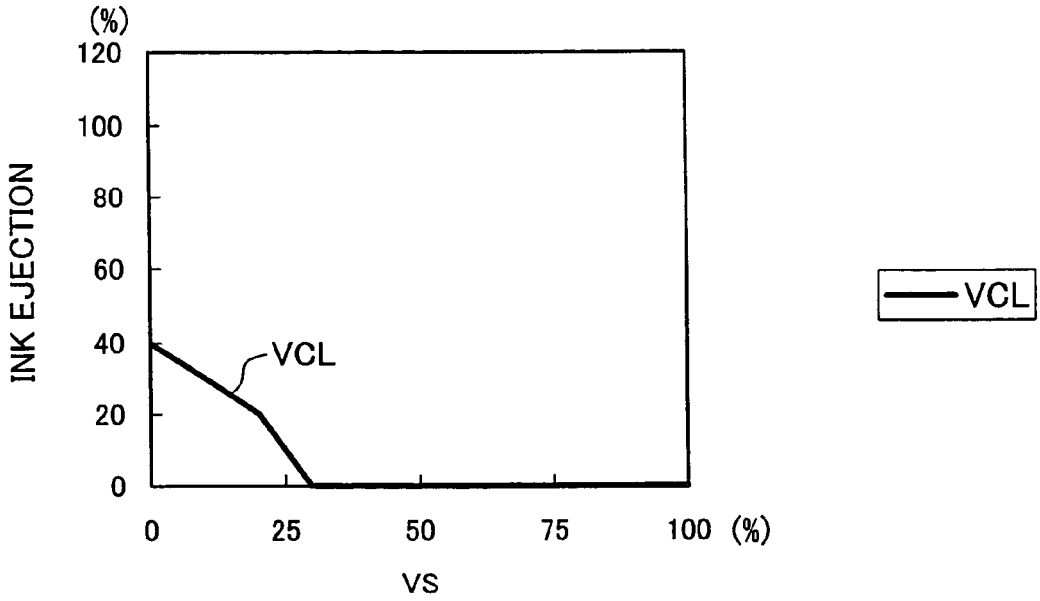
FIGS. 9(*a*) and 9(*b*) show the relationship between the amount of colored ink and the amount of enhancing ink in Example 4 of the first quality adjusting mode.
Figure 9B:
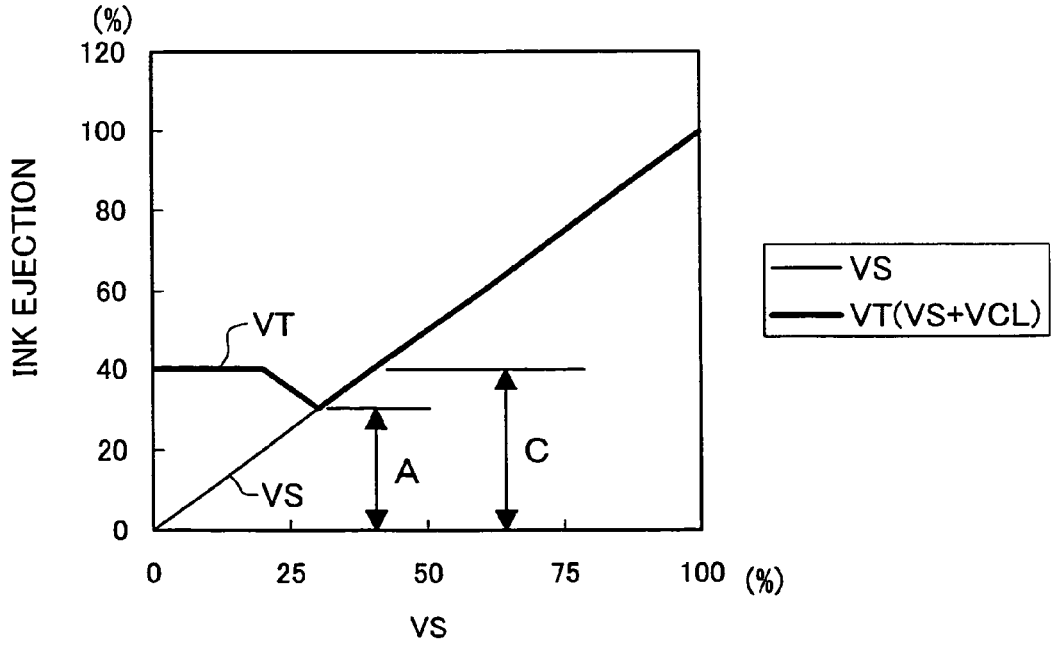

FIGS. 9(*a*) and 9(*b*) show the relationship between the discharged amount of colored ink VS and the discharged amount of enhancing ink VCL in Example 4 of the first quality adjusting mode.

The enhancing ink amount VCL is set so that the total ink amount VT is at least a first predetermined non-zero value A. In at least some portions of areas where the colored ink amount VS is lower than the first predetermined value A, the enhancing ink amount VCL is set so that the total ink amount VT is at least a first predetermined non-zero value A and not more than a third predetermined non-zero value C. The third predetermined value C is greater than the first predetermined value A. Thus, even when the printing medium has low gloss, the enhancing ink amount VCL is set so that the total ink amount VT is at least the first predetermined value A and not more than the third predetermined value C in areas where the colored ink amount VS is low, thereby consistently minimizing the difference in gloss. In the example in FIG. 9, the first predetermined value A is 30%, and the third predetermined value C is 40%, but these values A and C can be determined according to the type of inks and the type of printing medium.

B5. Example 5 of First Quality Adjusting Mode

Figure 10A:
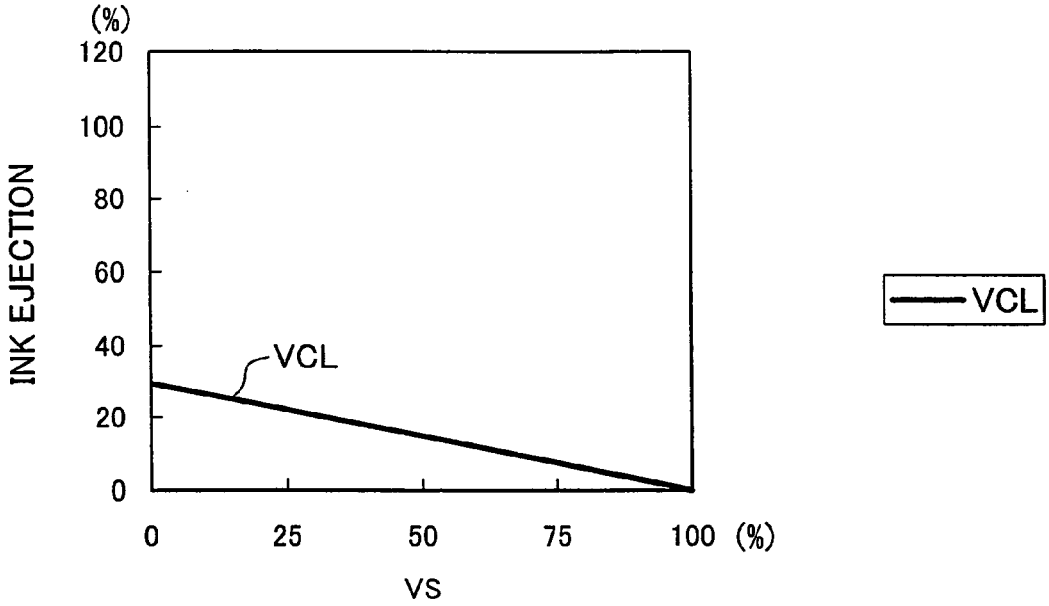
FIGS. 10(*a*) and 10(*b*) show the relationship between the amount of colored ink and the amount of enhancing ink in Example 5 of the first quality adjusting mode.
Figure 10B:
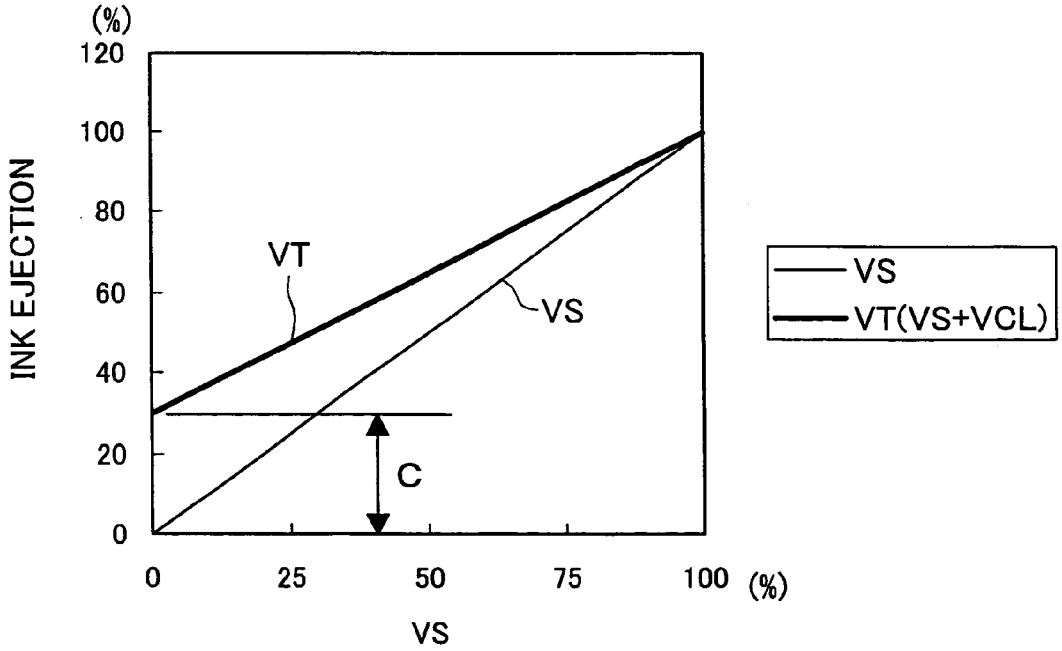

FIGS. 10(*a*) and 10(*b*) show the relationship between the discharged amount of colored ink VS and the discharged amount of enhancing ink VCL in Example 5 of the first quality adjusting mode.

The enhancing ink amount VCL is set so that the total ink amount VT is at least a third predetermined non-zero value C. Differences in gloss can thus be minimized consistently regardless of the colored ink amount VS even if the printing medium has low gloss. The enhancing ink amount VCL is also set so that the total ink amount VT does not decrease as the colored ink amount VS increases. Unevenness of gloss can thus be improved so as to avoid conspicuous boundaries with different gloss, even in print image areas where the colored ink amount VS continuously increases, such as gradation areas. In the example in FIGS. 10(*a*) and 10(*b*), the third predetermined value C is 30%, but the value C can be determined according to the type of inks and the type of printing medium.

B6. Example 6 of First Quality Adjusting Mode

Figure 11A:
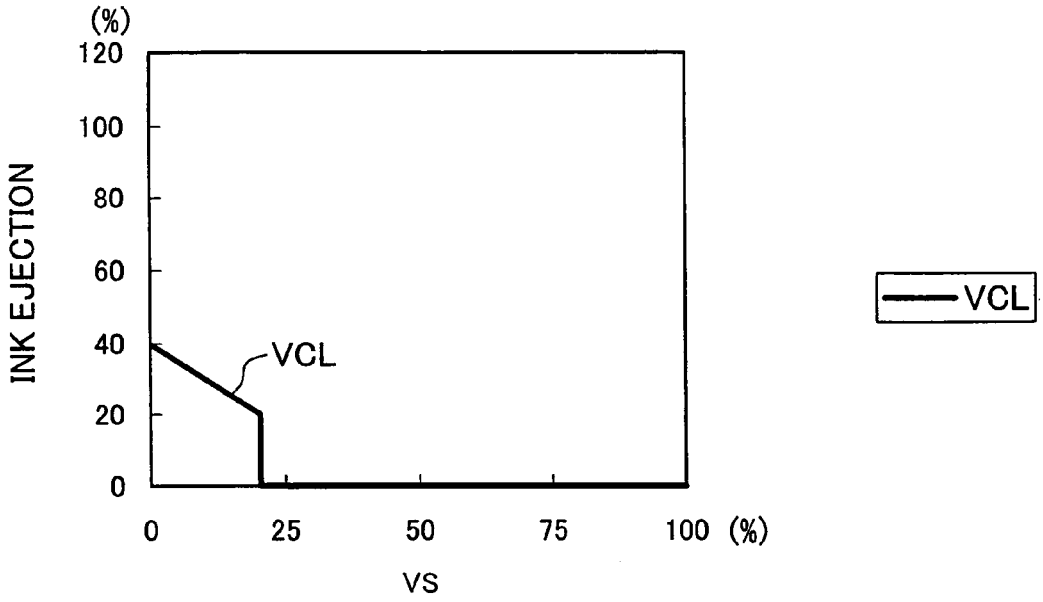
FIGS. 11(*a*) and 11(*b*) show the relationship between the amount of colored ink and the amount of enhancing ink in Example 6 of the first quality adjusting mode.
Figure 11B:
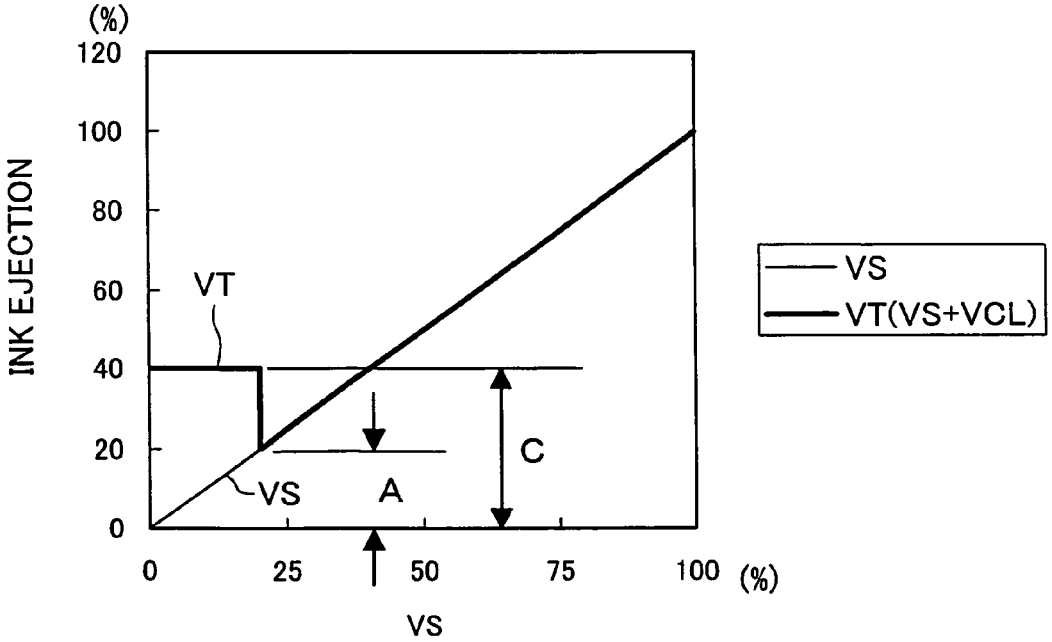

FIGS. 11(*a*) and 11(*b*) show the relationship between the discharged amount of colored ink VS and the discharged amount of enhancing ink VCL in Example 6 of the first quality adjusting mode.

The enhancing ink amount VCL is set so that the total ink amount VT is at least a first predetermined non-zero value A. In areas where the colored ink amount VS is lower than the first predetermined value A, the enhancing ink amount VCL is set so that the total ink amount VT is at least a third predetermined non-zero value C. The third predetermined value C is greater than the first predetermined value A. Thus, even when the printing medium has low gloss, the total ink amount VT is at least the third predetermined value C in areas where the colored ink amount VS is low, thereby allowing differences in gloss to be consistently minimized. In the example in FIGS. 11(*a*) and 11(*b*), the first predetermined value A is 20%, and the third predetermined value C is 40%, but the values A and C can be determined according to the type of inks and the type of printing medium.

B7. Example 7 of First Quality Adjusting Mode

Figure 12A:
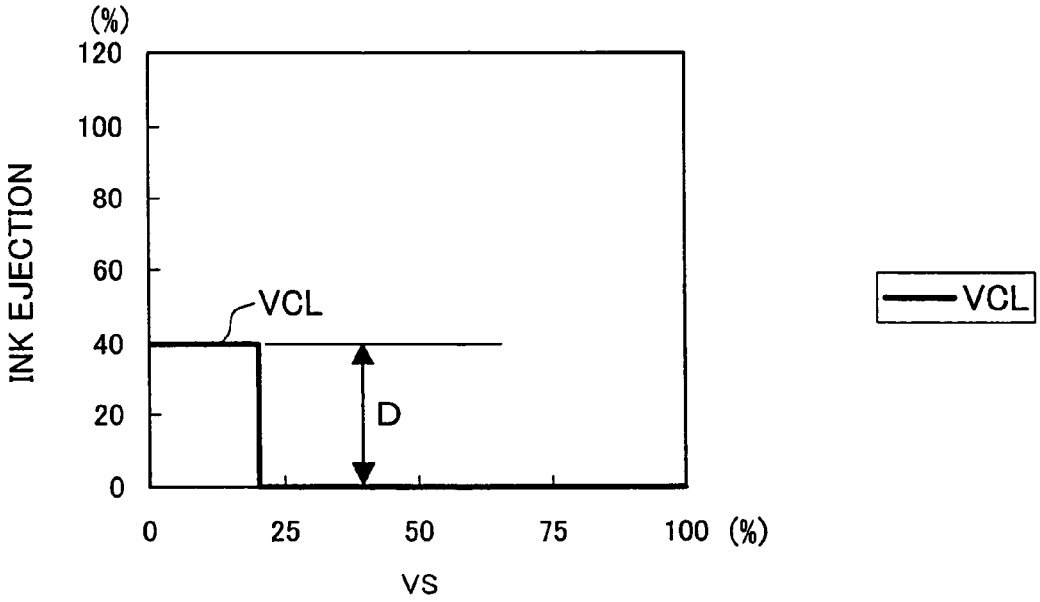
FIGS. 12(*a*) and 12(*b*) show the relationship between the amount of colored ink and the amount of enhancing ink in Example 7 of the first quality adjusting mode.
Figure 12B:
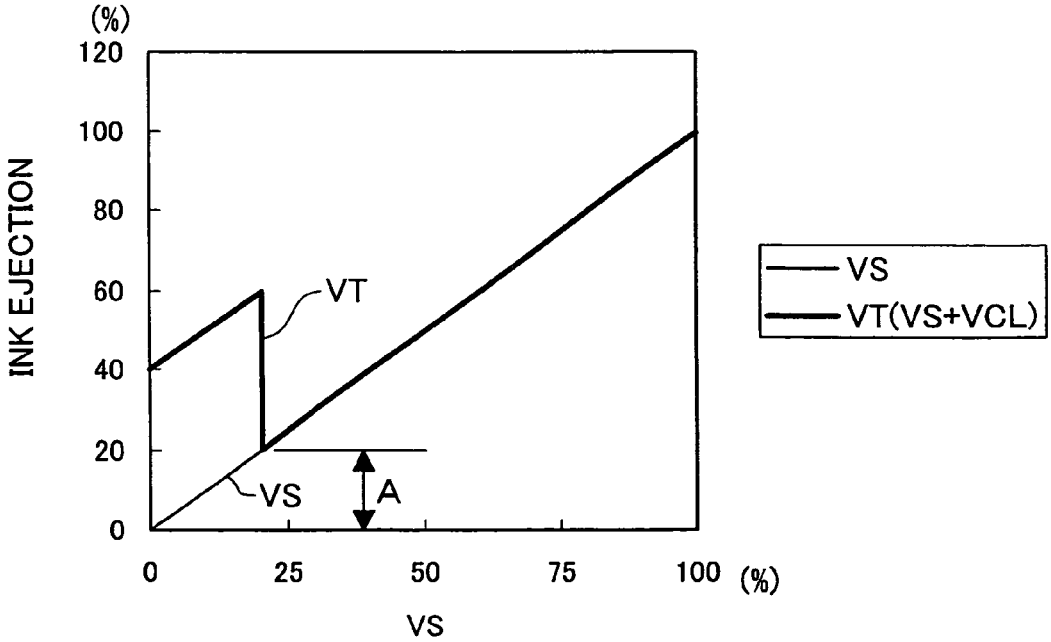

FIGS. 12(*a*) and 12(*b*) show the relationship between the discharged amount of colored ink VS and the discharged amount of enhancing ink VCL in Example 7 of the first quality adjusting mode.

The enhancing ink amount VCL is set so that the total ink amount VT is at least a first predetermined non-zero value A. In areas where the colored ink amount VS is lower than the first predetermined value A, the enhancing ink amount VCL is set to a fourth predetermined non-zero value D. The fourth predetermined value D is greater than the first predetermined value A. Thus, even when the printing medium has low gloss, the enhancing ink amount VCL has the fourth predetermined value D in areas where the colored ink amount VS is low, allowing differences in gloss to be consistently minimized. Furthermore, the enhancing ink amount VCL is constant in areas where the colored ink amount VS is lower than the first predetermined value A, thus simplifying the control of the enhancing ink amount VCL. In the example in FIGS. 12(*a*) and 12(*b*), the first predetermined value A is 20%, and the fourth predetermined value D is 40%, but the values A and D can be determined according to the type of inks and the type of printing medium.

B8. Example 1 of Second Quality Adjusting Mode

Figure 13A:
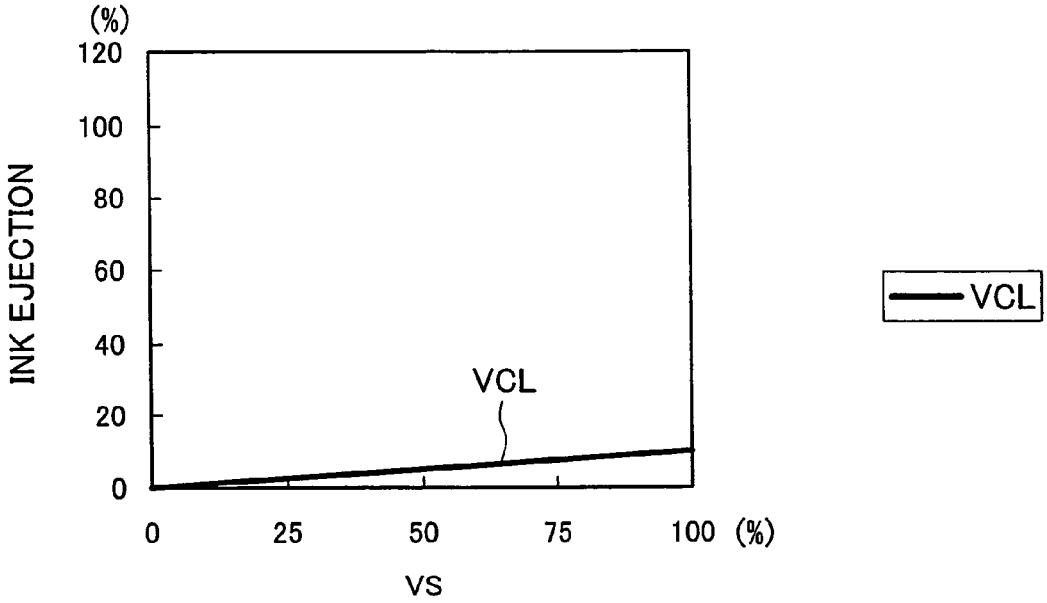
FIGS. 13(*a*) and 13(*b*) show the relationship between the amount of colored ink and the amount of enhancing ink in Example 1 of the second quality adjusting mode.
Figure 13B:
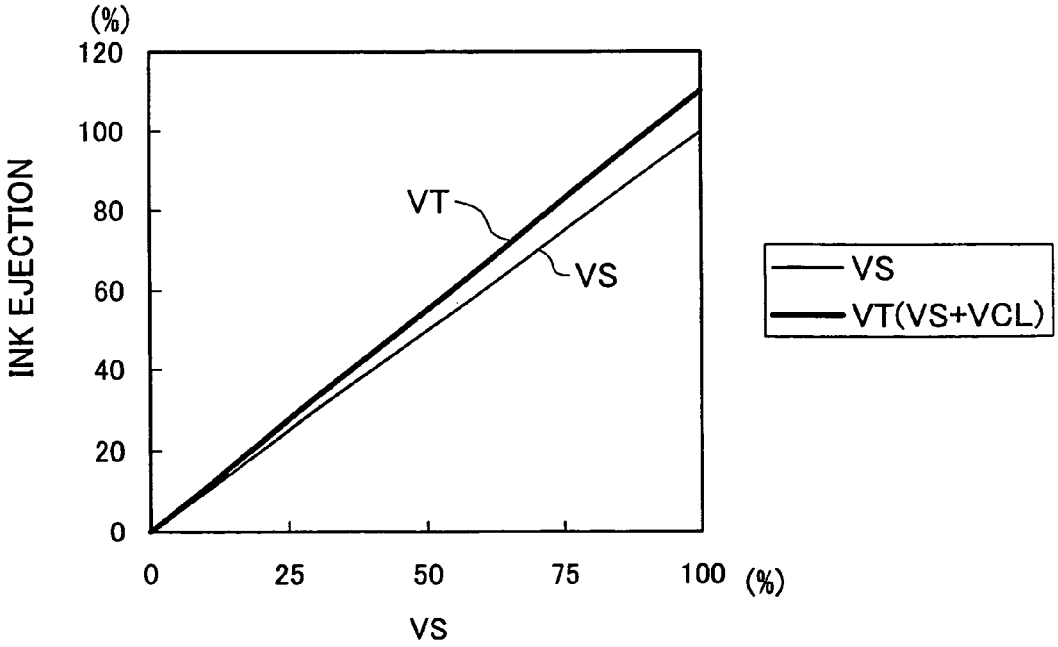

FIGS. 13(*a*) and 13(*b*) show the relationship between the discharged amount of colored ink VS and the discharged amount of enhancing ink VCL in Example 1 of the second quality adjusting mode.

The enhancing ink amount VCL is set so that a VCL value for the colored ink amount VS of about 0% is lower than a VCL value for the VS value of about 100%. This reduces unevenness of coloring in image areas due to a difference in the colored ink amount VS. In areas where the colored ink amount VS is low, a small amount of enhancing ink is ejected to enhance color development, thereby conserving the enhancing ink amount VCL. The smaller amount of quality enhancing ink CL will prevent the printing medium from wrinkling, prevent the ejected ink from taking a longer time to dry, and conserve the quality enhancing ink. The enhancing ink amount VCL is also set so as not to decrease as the colored ink amount VS increases in this example. It is thus possible to ensure that the proper amount of enhancing ink is discharged as befits the colored ink amount VS.

B9. Example 2 of Second Quality Adjusting Mode

Figure 14A:
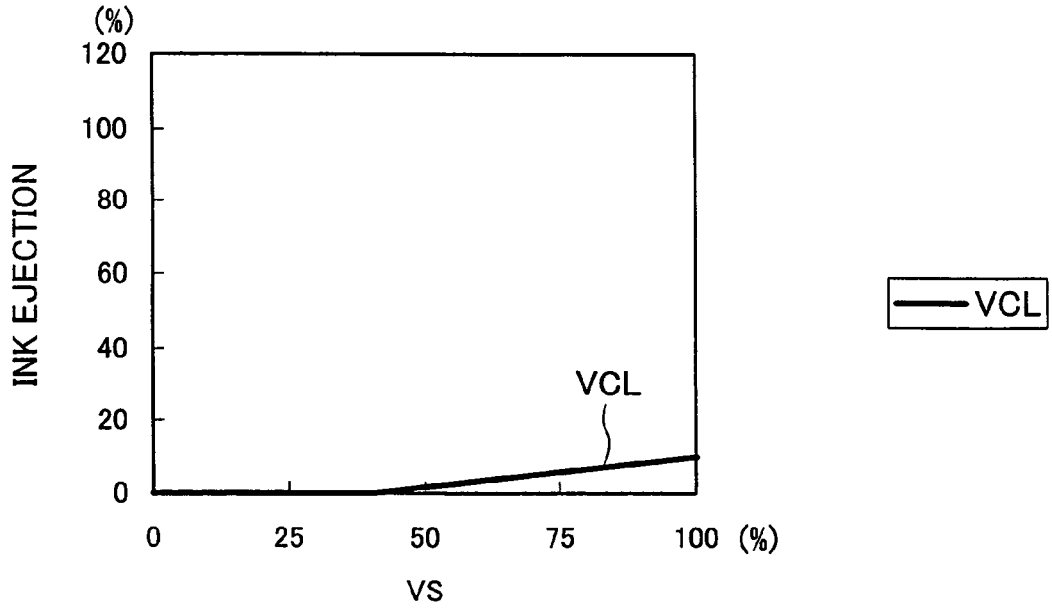
FIGS. 14(*a*) and 14(*b*) show the relationship between the amount of colored ink and the amount of enhancing ink in Example 2 of the second quality adjusting mode.
Figure 14B:
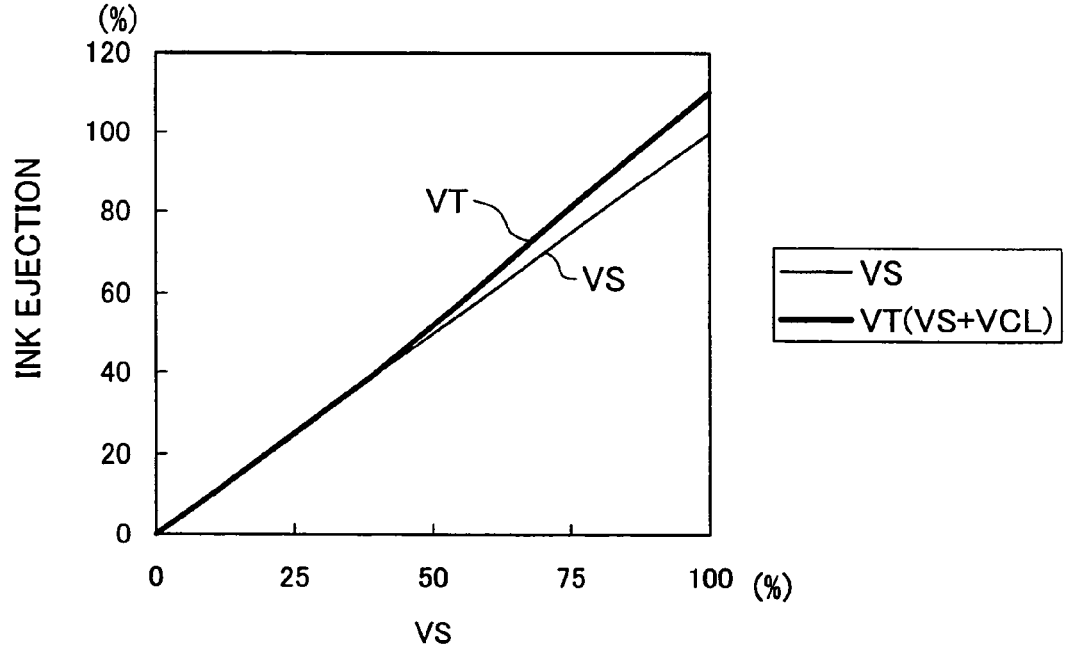

FIGS. 14(*a*) and 14(*b*) show the relationship between the discharged amount of colored ink VS and the discharged amount of enhancing ink VCL in Example 2 of the second quality adjusting mode.

The enhancing ink amount VCL is set to increase as the colored ink amount VS increases. In addition, no enhancing ink is discharged in areas where the colored ink amount VS is lower than a predetermined value. In areas where the colored ink amount VS is low and there is no conspicuous unevenness in the color development of the ink, no enhancing ink is used, allowing the printing medium to be prevented from wrinkling and the ejected ink from taking a longer time to dry, while also allowing the quality enhancing ink to be conserved.

B10. Example 3 of Second Quality Adjusting Mode

Figure 15A:
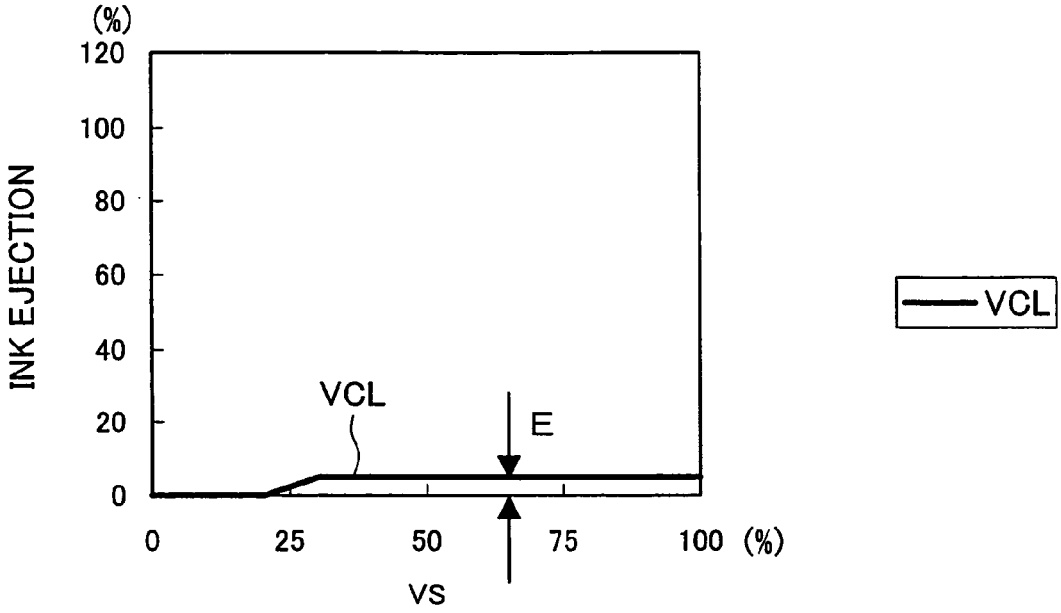
FIGS. 15(*a*) and 15(*b*) show the relationship between the amount of colored ink and the amount of enhancing ink in Example 3 of the second quality adjusting mode.
Figure 15B:
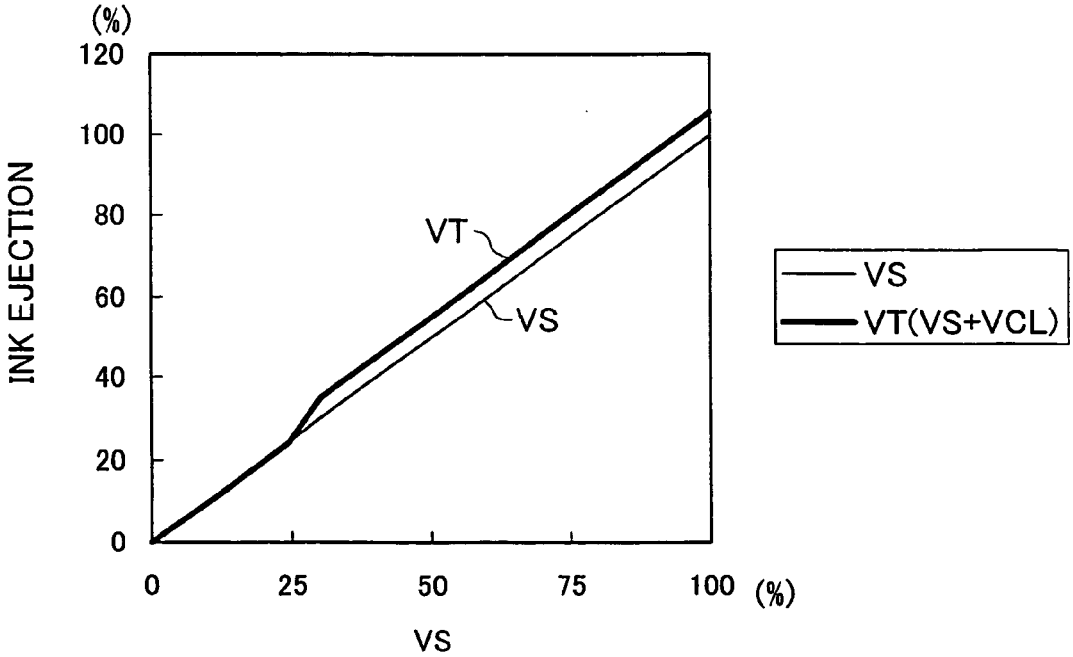

FIGS. 15(*a*) and 15(*b*) show the relationship between the discharged amount of colored ink VS and the discharged amount of enhancing ink VCL in Example 3 of the second quality adjusting mode.

The enhancing ink amount VCL is set so that no enhancing ink is ejected in areas where the colored ink amount VS is lower than a predetermined value. In areas where the colored ink amount VS is low and there is no conspicuous unevenness in the color development of the ink, no enhancing ink is used, allowing the printing medium to be prevented from wrinkling and the ejected ink from taking a longer time to dry, while also allowing the quality enhancing ink to be conserved. In addition, the enhancing ink amount VCL is set to at least a fifth predetermined non-zero value E, in areas where the colored ink amount VS is greater than another predetermined value. Thus, when the enhancing ink amount VS needed to improve color development is virtually constant regardless of the colored ink amount VS, the color development of the ink can be improved without using more than the necessary amount of enhancing ink. The enhancing ink amount VCL may smoothly increase along with the colored ink amount VS, from 0% to the fifth predetermined value E. This can prevent conspicuous boundaries between areas where enhancing ink is ejected and areas where no enhancing ink is ejected. In the example in FIGS. 15(*a*) and 15(*b*), the fifth predetermined value E is 5%, but the value E can be determined according to the type of inks and the type of printing medium.

B11. Example 4 of Second Quality Adjusting Mode

Figure 16A:
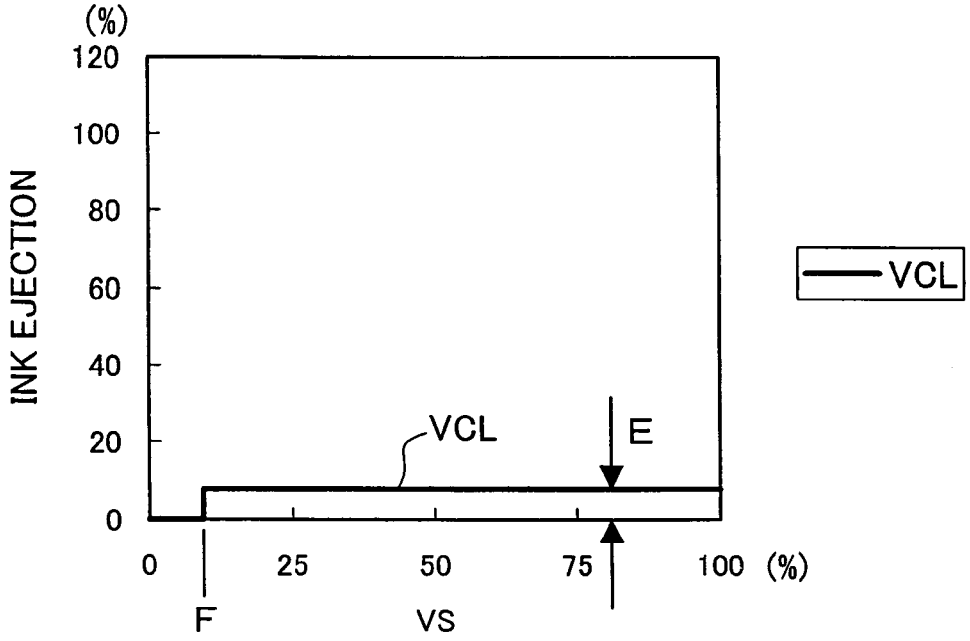
FIGS. 16(*a*) and 16(*b*) show the relationship between the amount of colored ink and the amount of enhancing ink in Example 4 of the second quality adjusting mode.
Figure 16B:
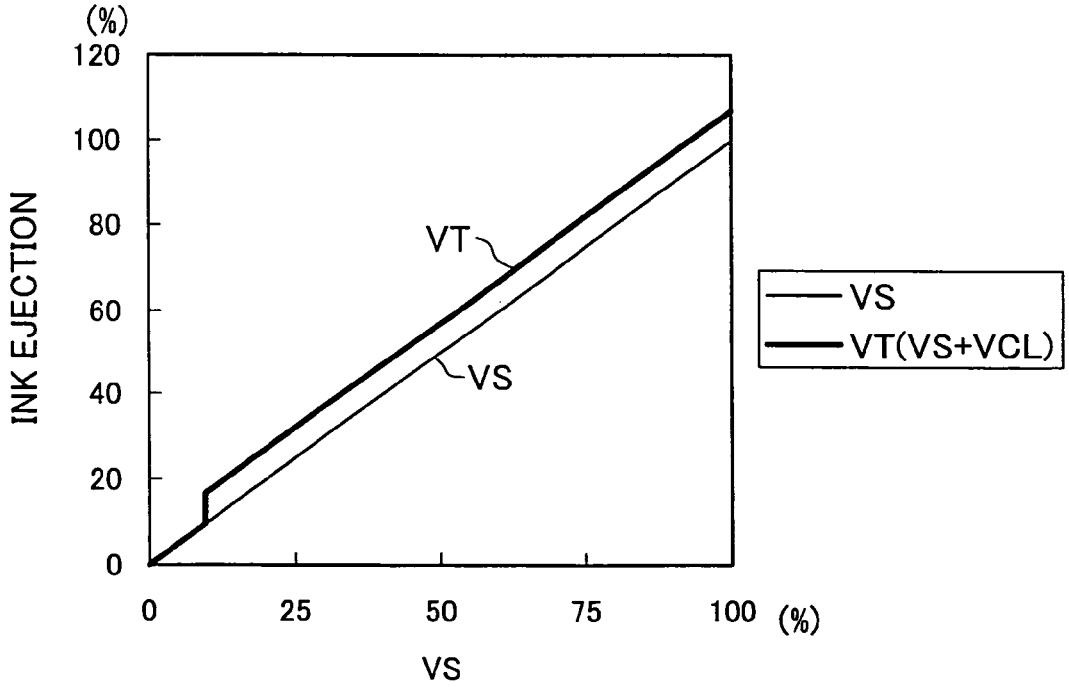

FIGS. 16(*a*) and 16(*b*) show the relationship between the discharged amount of colored ink VS and the discharged amount of enhancing ink VCL in Example 4 of the second quality adjusting mode.

The enhancing ink amount VCL is set at zero when the colored ink amount VS is equal to or lower than a predetermined value F, while the amount VCL is set at a non-zero fixed value E when the colored ink amount VS is greater than the predetermined value F. This setting provide substantially the same effects as the Example 3 described with reference to FIGS. 15(*a*) and 15(*b*). The enhancing ink amount VCL shows a stepwise change in this Example 4 while it changes smoothly in Example 3. The smooth change may have an advantage that it makes a boundary between an image area with the enhancing ink and another image area without the enhancing ink more inconspicuous. Example 3 is more preferable to Example 4 in this point.

Figure 17A:
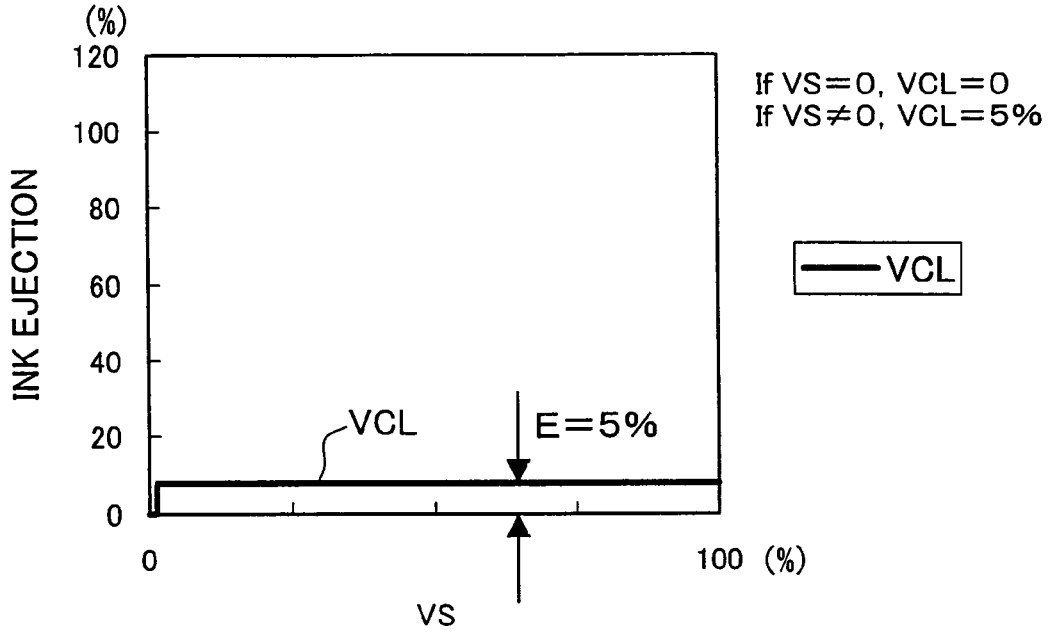
FIGS. 17(*a*) and 17(*b*) show a concrete example of Example 4.
Figure 17B:
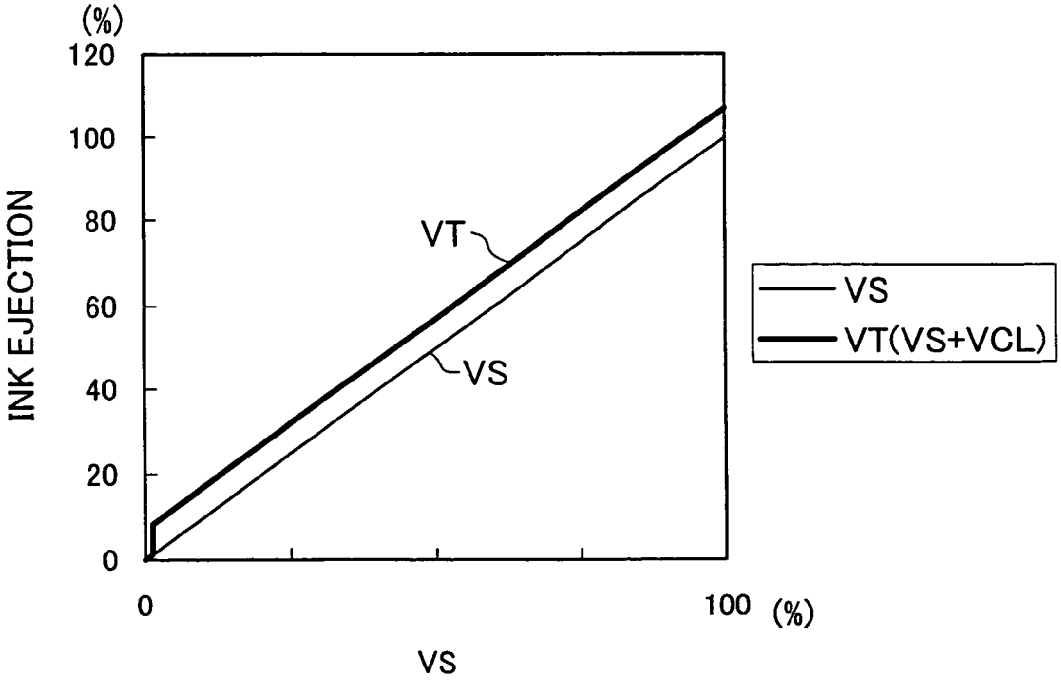

FIGS. 17(*a*) and 17(*b*) show a concrete example of Example 4. The enhancing ink amount VCL is set at zero when the colored ink amount VS is zero, and the amount VCL is set at a fixed value E of 5% when the colored ink amount VS is greater than zero. Improvement of the color development of the ink is not required in an image area where the colored ink amount VS is zero. The setting of FIGS. 17(*a*) and 17(*b*) will prevent unnecessary use of the quality enhancing ink.

B12. Example 5 of Second Quality Adjusting Mode

Figure 18A:
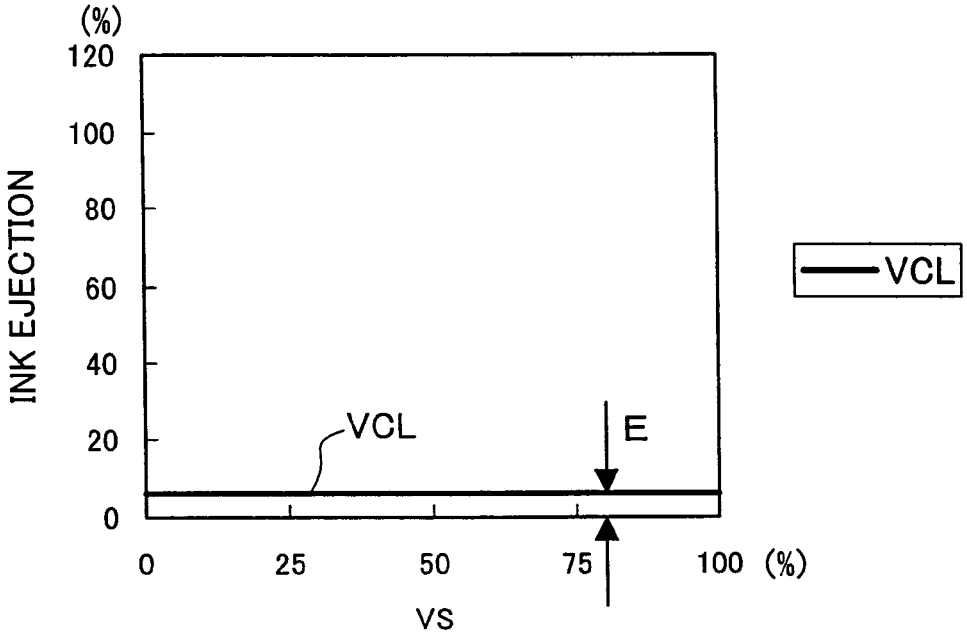
FIGS. 18(*a*) and 18(*b*) show the relationship between the amount of colored ink and the amount of enhancing ink in Example 5 of the second quality adjusting mode.
Figure 18B:
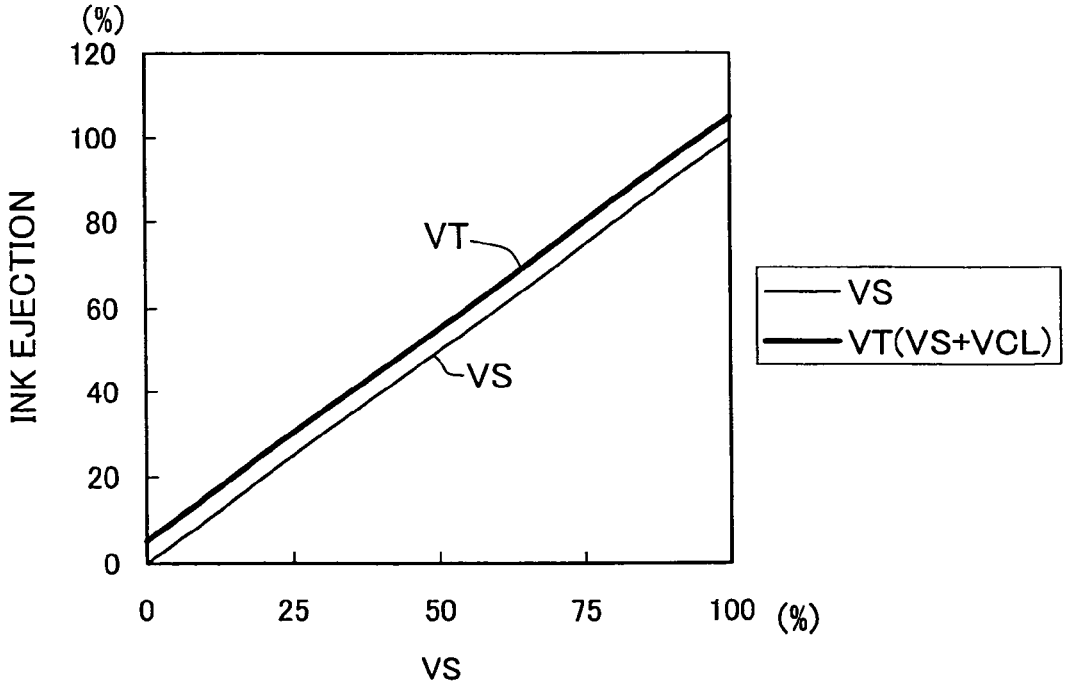

FIGS. 18(*a*) and 18(*b*) show the relationship between the ejected amount of colored ink VS and the ejected amount of enhancing ink VCL in Example 5 of the second quality adjusting mode.

The enhancing ink amount VCL is set at a fixed value E that is more than 0% and less than 100% regardless of the colored ink amount VS. This setting have an advantage that it will attain sufficient image quality enhancement (especially the color development of the ink), and another advantage that it will make inconspicuous a boundary between an image area with the enhancing ink and another image area without the enhancing ink. Example 5 is more preferable to Example 4 in this point.

Figure 19:
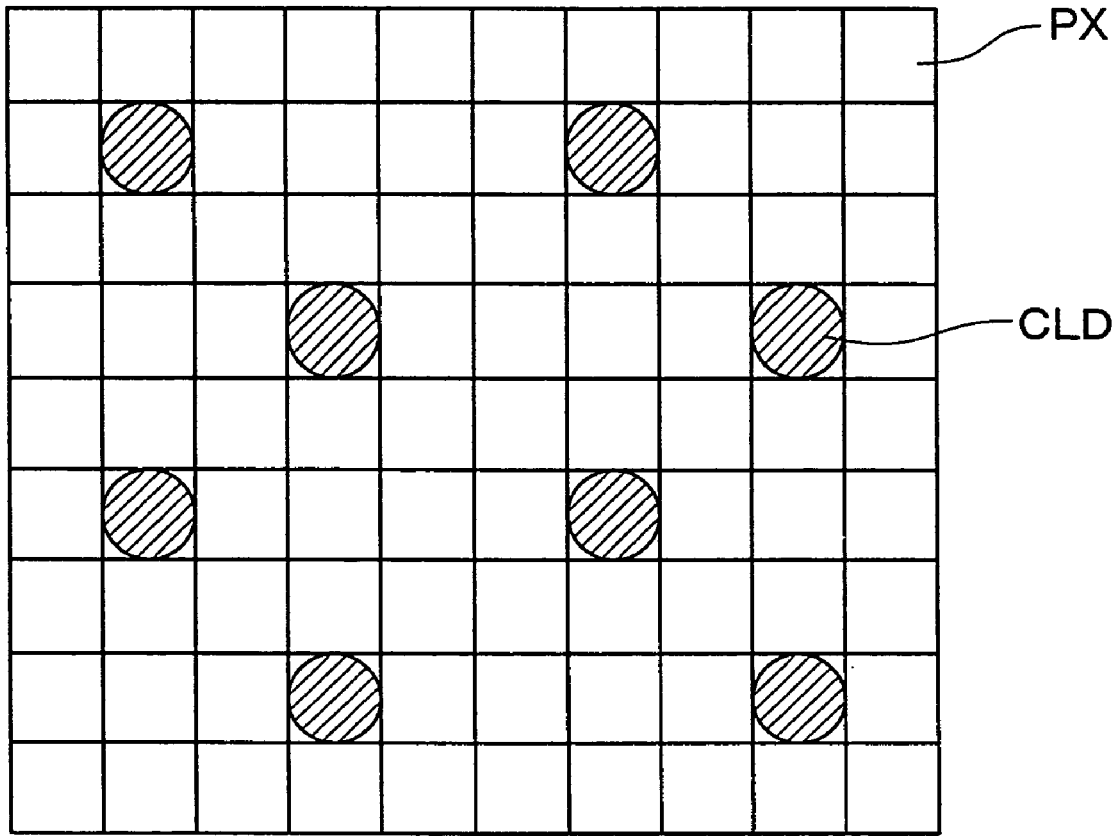
FIG. 19 shows an exemplary arrangement of quality enhancing ink dots.

FIG. 19 shown an exemplary arrangement of quality enhancing ink dots. In Example 5, the quality enhancing ink dots CLD are uniformly dispersed within a printing area of the printing medium. In FIG. 19, the value E of the quality enhancing ink amount VCL (FIG. 18(*a*)) is 10%, and the ink dot CLD is formed once every 10 pixels PX. It should be noted that the ink amount is defined by a dot recording rate, which is 100% when every pixel has one ink dot.

If the quality enhancing ink dot CLD was formed at almost every pixel, they would cause various troubles such as bleeding of colored ink dots, longer time for drying ink, and wrinkling of the printing medium. The uniform dispersed arrangement of the quality enhancing ink dots CLD in the printing area as shown in FIG. 19 will prevent these troubles. It should be noted that one pixel PX for printing is so small that each pixel is not discernable with naked eyes. Accordingly the uniform dispersed arrangement of the quality enhancing ink dots CLD will attain sufficient effect of image quality enhancement (especially the color development of the ink). In order attain this effect, the value E of the quality enhancing ink amount VCL may be between about 1% and 20%, preferably between about 1% and 10%, and most preferably between about 5% and 10%.

The arrangement of the quality enhancing ink dots CLD is not limited to the example of FIG. 19 where they are dispersed in completely uniform pattern, but it is preferable that they are dispersed in substantially uniform pattern. This arrangement of the quality enhancing ink dots CLD is applicable to the other examples described before.

As described in the above examples, the quality enhancing ink CL may be ejected only in a portion of the entire range of the colored ink amount VS. This allows the quality enhancing ink CL to be conserved. Alternatively the quality enhancing ink CL may be ejected in the entire range of the colored ink amount. This can prevent conspicuous boundaries between areas in which enhancing ink has been ejected and areas where no enhancing ink has been ejected.

C. Second Embodiment

C1. General Structure of the Second Embodiment

Figure 20:
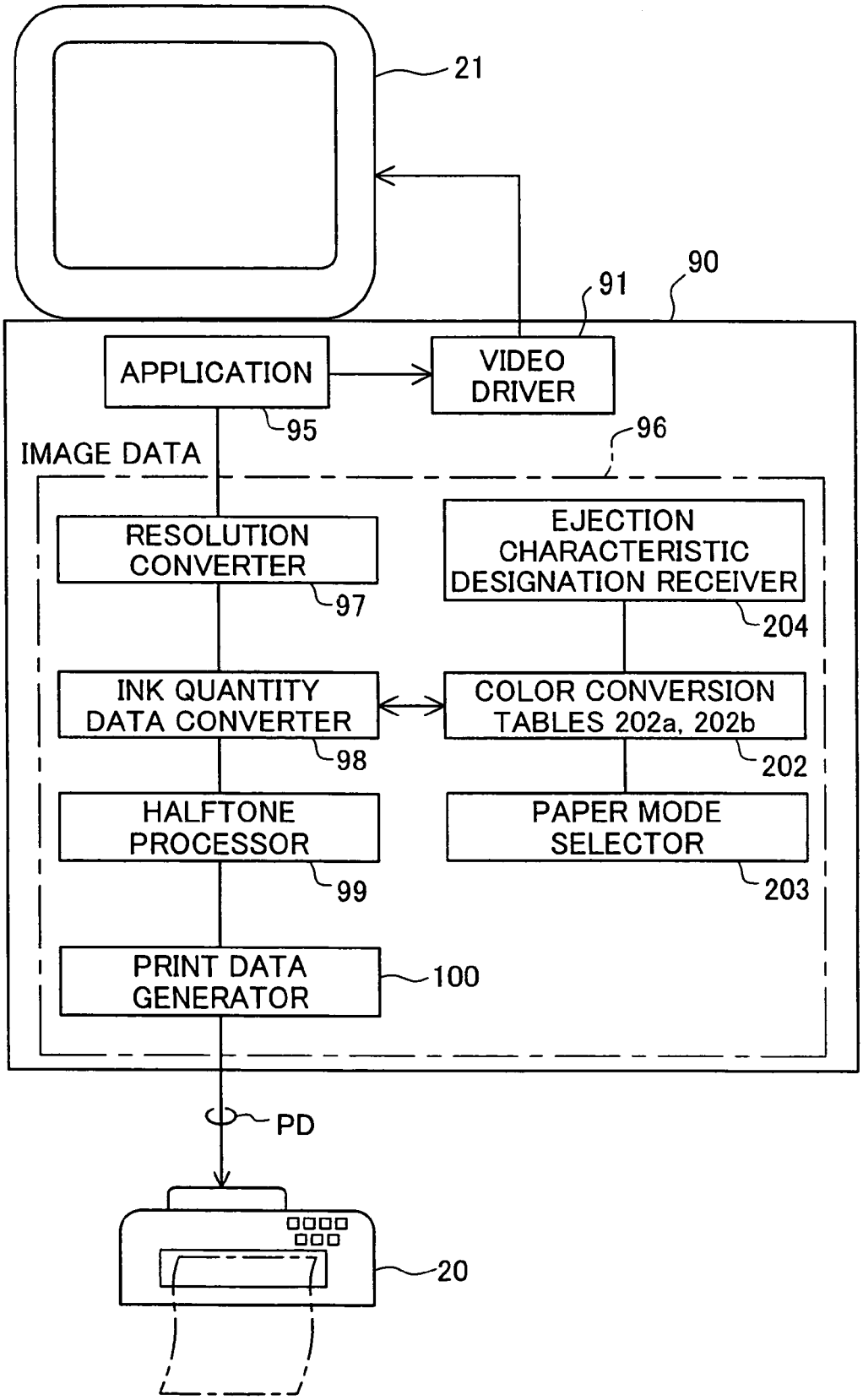
FIG. 20 is a block diagram showing the arrangement of a printing system in a second embodiment of the present invention.

FIG. 20 is a block diagram illustrating the structure of the printing system in a second embodiment of the invention. The printer driver 96 in this printing system includes two color conversion tables 202*a*, 202*b*, a paper mode selector 203, and an ejection characteristic instruction receiver 204 in place of the look-up table 102 and the adjusting mode selector 103 in the system of the first embodiment (FIG. 1).

When printer 20 has a plurality of available paper modes, the user can select the paper mode to be used, using the paper mode selector 203. Where only one paper mode is available, the process performed by paper mode selector 203, or the paper mode selector 203 itself, may be omitted. In the second embodiment, one may select a first paper mode when using "glossy paper", and a second paper mode when using "non-glossy paper". The first and second paper modes correspond to the first and second adjusting modes in the first embodiment.

A color conversion tables 202 is provided for each paper mode selectable by means of the paper mode selector 203. Thus, in the present embodiment, there is provided a first color conversion table 202*a* for use when the first paper mode is selected, and a second color conversion table 202*b* for use when the second paper mode is selected. Thus, depending on the selected paper mode, the ink quantity data converter 98 selectively refers to either the first color conversion table 202*a* or the second color conversion table 202*b*. It then converts RGB data to multilevel gray scale data representing ink ejection quantity, as described above.

As described in the first embodiment, in both the first paper mode (first quality adjusting mode) and the second paper mode (second quality adjusting mode), the amount of the quality enhancing ink CL preferably will be determined depending on the total amount of colored inks VS, which is determined from RGB data. Accordingly, in the second embodiment, the color conversion table 202 determines the quality enhancing ink amount from RGB data. FIG. 21 is a table arrangement diagram illustrating an exemplary arrangement for first and second color conversion tables 202*a*, 202*b*. In the first and second color conversion tables 202*a*, 202*b*, RGB data, CMYK data, and quality enhancing ink data CL each has values of 0–225, with 256 levels (8 bits) for each color. The table 202 may also include ink data for light cyan ink LC and light magenta ink LM (FIG. 4). In FIG. 21, these two ink data are omitted for convenience of illustration. The term "CMYK data" in the description below may mean the ink data for all available colored inks in the printer 20.

For RGB data, 256 gradation levels for the RGB color components are divided into 16 equal intervals to give reference points. The three-dimensional RGB color space, defined by an orthogonal space having the R, G, and B colors as its axes, is assigned 17 grid points on each of the R, G, and B axes, with the resultant three-dimensional grid providing the reference points. That is, there are a total of 173 ( denotes an exponent) reference points, and the first and second color conversion tables 202*a*, 202*b* have 173 entries for RGB data, CMYK data, and print quality-enhancing ink data CL. As the amount of print quality-enhancing ink CL is different in the first paper mode and the second paper mode, settings in the first and second color conversion tables 202***a*, 202*b* will differ between the two so that print quality-enhancing ink CL can be ejected onto the proper areas.

The print quality-enhancing ink amount VCL in first paper mode and that in second paper mode are reflected in the first and second color conversion tables 202*a*, 202*b*, respectively. The characteristic curve of the enhancing ink amount, or the enhancing ink amount values VCL depending on the colored ink amount values VS, such as those shown in FIG. 6(*a*) and 13(*a*), are established using a specific standard glossy paper or a specific standard non-glossy paper. That is, settings can be made so as to give optimal gloss when the specific glossy paper or non-glossy paper is used. However, there is typically available on the market a wide selection of glossy and non-glossy papers having different specifications, and printing will sometimes be performed using these glossy and non-glossy papers. In such instances, the quality-enhancing ink amount VCL determined using the first and second color conversion tables 202*a*, 202*b* will not always afford optimal gloss level. However, the user will desire the same level of gloss regardless of the specifications of the glossy or non-glossy paper. In such instances, it may be desirable to enable the user to re-adjust the ejection amount of print quality-enhancing ink CL.

Figure 22:
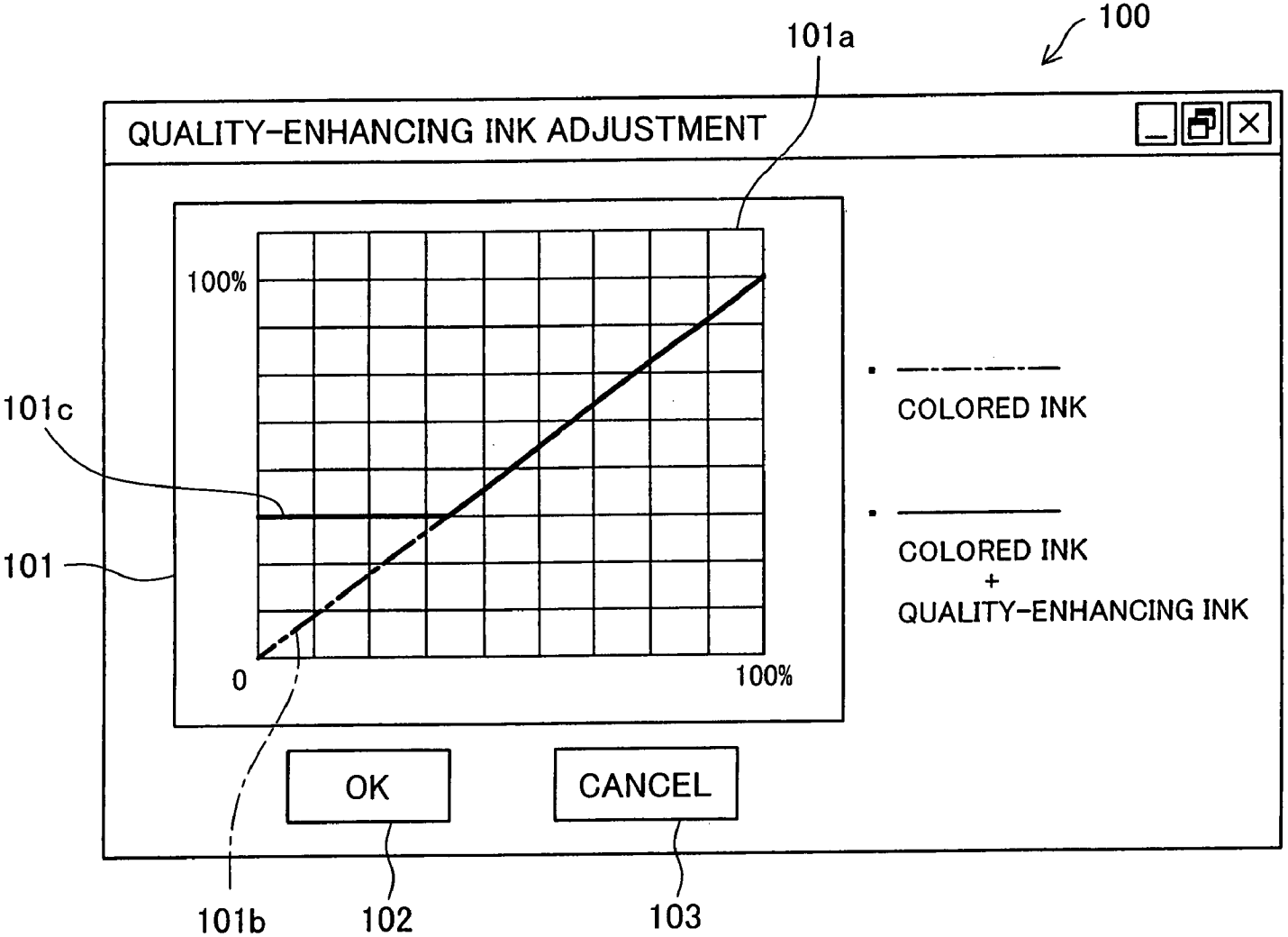
FIG. 22 is a screen shot of a quality-enhancing ink adjustment window.

Accordingly, in the present embodiment, an ejection characteristic designation receiver 204 is provided to printer driver 96. This receiver 204 receives ejection characteristics for modifying the quality enhancing ink amount VCL from the user, and can make modifications to settings in the first and second color conversion tables 202*a*, 202*b*. FIG. 22 is a screen shot showing a quality-enhancing ink adjustment window 100 displayed on CRT 21, on which ejection characteristic designation receiver 204 receives the ejection characteristics input from the user. This window 100 is displayed by means of an operative of the printer driver 96. In the drawing, the window 100 contains a graph window 101 which shows the relationship between the colored ink amount VS and the total ink amount VT of colored inks and the print quality-enhancing ink CL.

The window 101 shows an ink amount relationship image 101*a* including a colored ink amount graph 101*b* and a total ink amount graph 101*c*. The shape of the total ink amount graph 101*c* can be changed using a mouse or other input device. By modifying the total ink amount graph 101*c* on the ink amount relationship image 101*a*, the amount of print quality-enhancing ink CL can be modified. After making the desired changes, the user clicks on the OK button 202 to confirm the changes. To discard changes, the user clicks the Cancel button 203. In this case, the amount of print quality-enhancing ink CL will be set to a predetermined default value.

C2. Color Conversion Process

Figure 23:
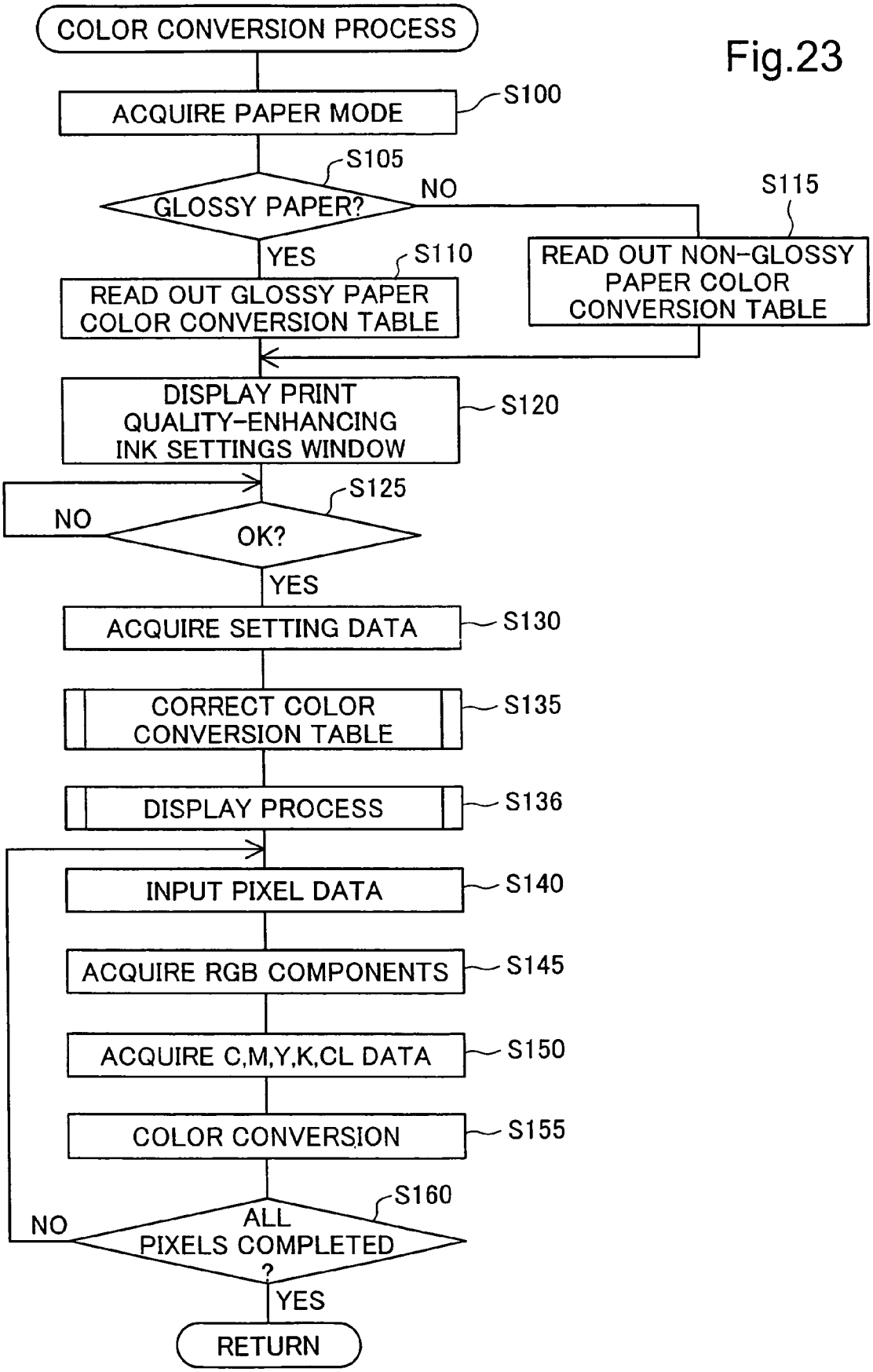
FIG. 23 is a flow chart describing the color conversion process.

As noted, in the ink quantity data converter 98 there is performed a color conversion process to convert RGB data into multilevel gradation data for the available inks in the printer 20. A flow chart describing the color conversion process pertaining to the present embodiment is shown in FIG. 23. In the drawing, the paper mode selected by the user from an interface window (not shown) is acquired (Step S100), and from the acquired mode it is determined whether glossy paper is being used (Step S105). If the selected mode is glossy paper mode, the first color conversion table 202*a* for use with glossy paper is read out; if on the other hand, non-glossy paper mode has been selected, the second color conversion table 202*b* for use with non-glossy paper is read out (Step S110 or S115). The print quality-enhancing ink adjustment window 100 shown in FIG. 22 is then displayed on CRT 21. A corresponding relationship of colored ink amount VS to the total ink amount VT of the colored ink and the print quality-enhancing ink CL, predetermined in the first or second color conversion table 202*a*, 202*b* on the basis of the selected paper mode, is displayed on the window 101, so the user can refer to this corresponding relationship when changing ejection quantities (Step S120).

At this point, it is determined whether the user has clicked the OK button 202 after making changes from the print quality-enhancing ink adjustment window 100 (Step S125). If the OK button 202 has been clicked, settings data specifying the adjusted quality-enhancing ink amount VCL set on the window 100 is acquired (Step S130). On the basis of the acquired settings data, a color conversion table correction process is then performed to correct the quality-enhancing ink amount specified in the first or second color conversion table 202*a*, 202*b*. This color conversion table correction process is described later (Step S135). Once the first or second color conversion table 202*a*, 202*b* has been corrected, a display process to display visually on CRT 21 the corrected quality-enhancing ink ejection status on the basis of the corrected first or second color conversion table 202*a*, 202*b* is performed. This display process is described later (Step S136).

Once the user has visually confirmed the quality-enhancing ink ejection status through this display process, image data for each pixel is input (Step S140), and RGB components of the pixel data are acquired (Step S145). Next, on the basis of gray levels in the RGB data, CMYK data for the colored inks and data for the print quality-enhancing ink CL are acquired from the first or second color conversion table 202*a*, 202*b* in Step S110 or S115 (Step S150), whereby the pixel data is color converted into the C,M,Y,K,CL data (Step S155). This process is performed on all pixels of the image data (Step S160). By means of this process, there can be generated print data that enables print quality-enhancing ink CL to be ejected in accordance with user preference.

Figure 24:
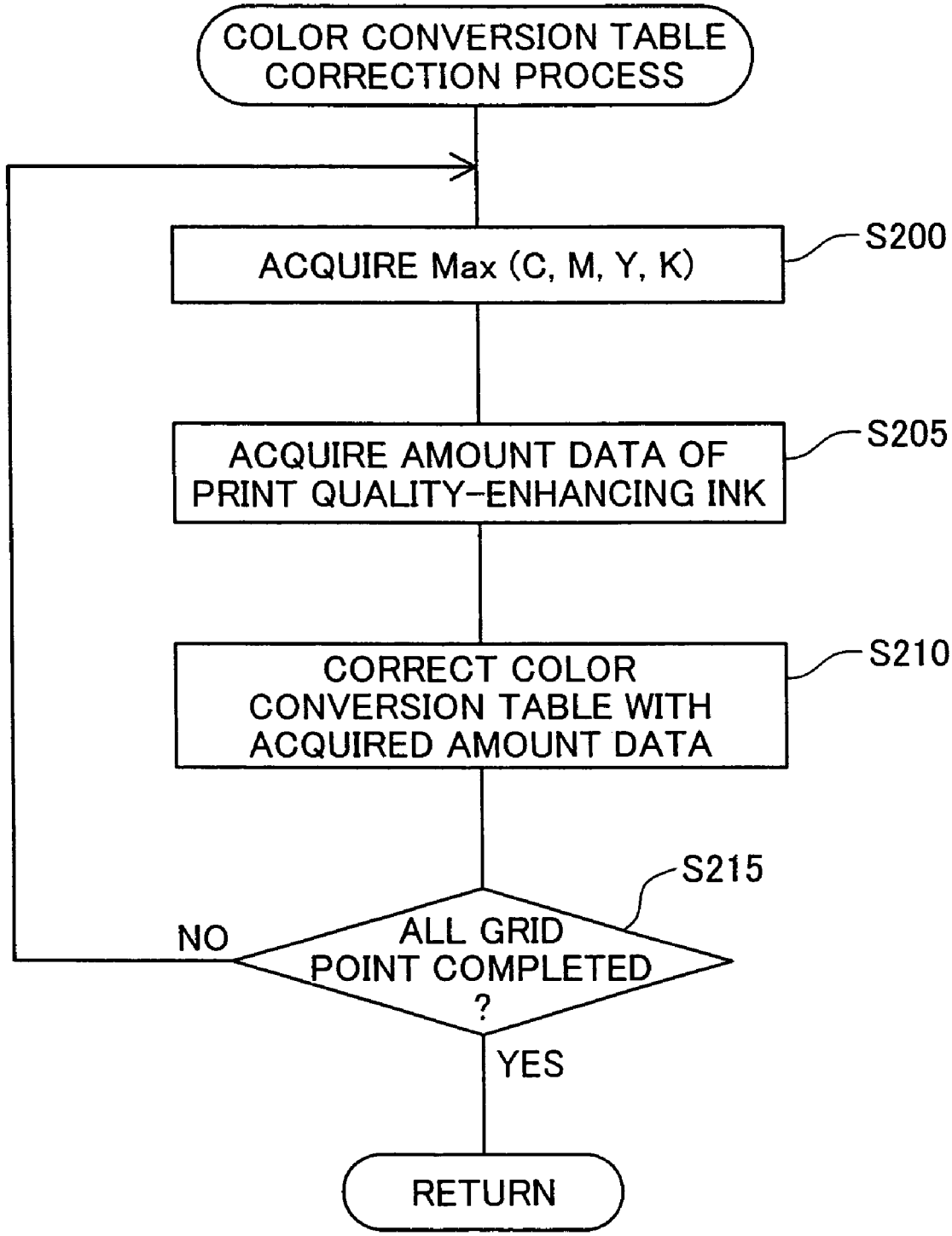
FIG. 24 is a flow chart illustrating the details of the color conversion table correction process.

FIG. 24 is a flow chart illustrating the details of the color conversion table correction process mentioned above. In the process of correcting print quality-enhancing ink amount specified in first or second color conversion table 202*a*, 202*b*, shown in the drawing, data indicating maximum value is acquired from the CMYK data on the grid points. For example, where the C data is level 0, M data is level 127, Y data is level 100, and K data is level 0, the maximum value is the 127 level for the M data (Step S200). Alternatively, the total sum of the CMYK data may be used instead of the maximum value. Next, a level of the print quality-enhancing ink CL for this 127 level is acquired from the settings data (Step S205). On the basis of the acquired value, the amount of the print quality-enhancing ink CL specified on first or second color conversion table 202*a*, 202*b* is then corrected (Step S210). This process is performed on all pixels of the image data (Step S215).

Figure 25:
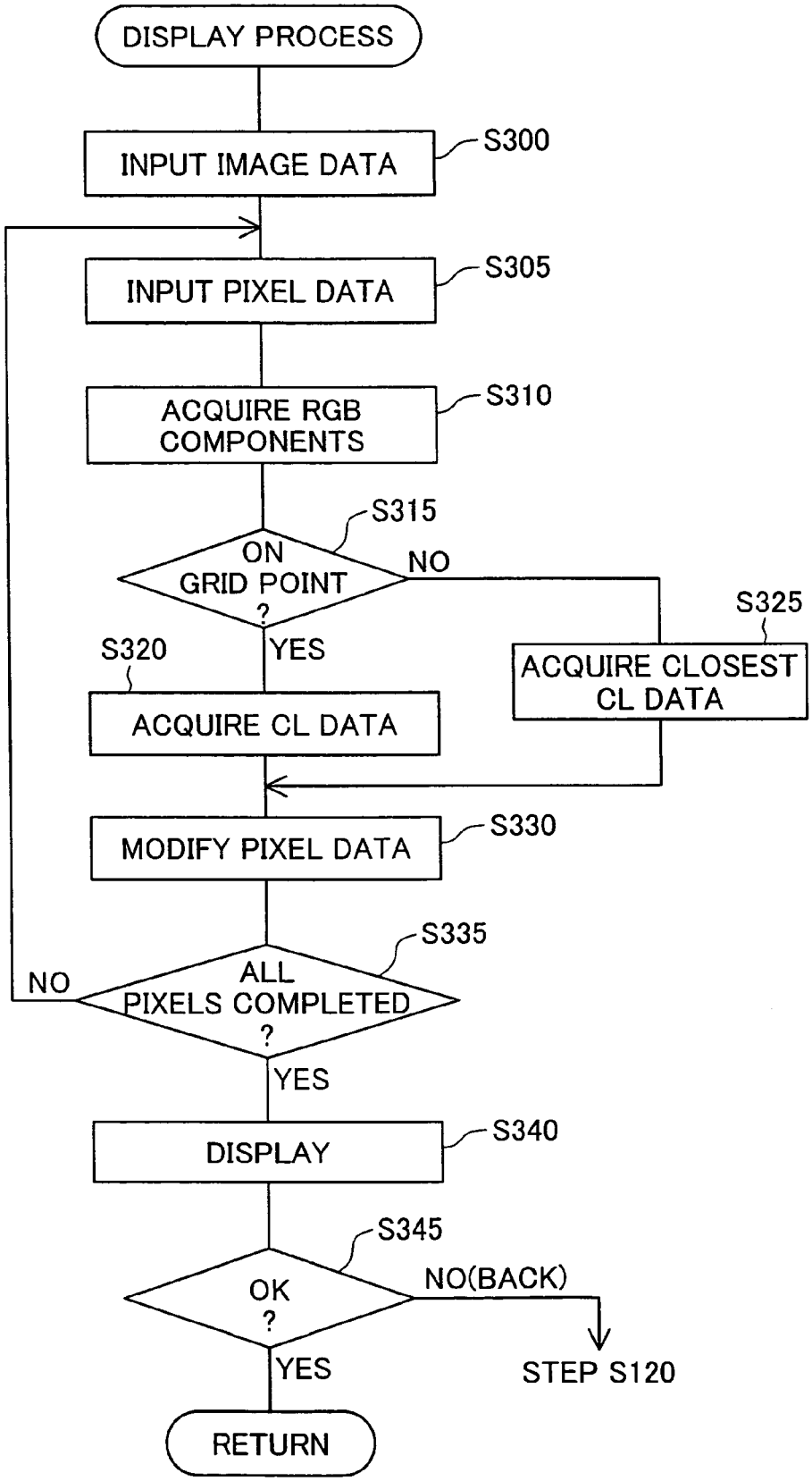
FIG. 25 is a flow chart illustrating the details of the display process.

FIG. 25 is a flow chart illustrating the details of the display process mentioned above. As shown in the drawing, the image data is input initially (Step S300). Next, image data for each pixel is input (Step S305), and RGB components of the pixel data are acquired (Step S310). At this point, a determination is made as to whether the RGB components are of a grid point of the color conversion table (Step S315), and where they are of a grid point, the amount data for the quality-enhancing ink CL specified for this grid point is acquired (Step S320). If the RGB components are not of a grid point, the closest grid point to a point represented by the RGB components is found, and the amount of the print quality-enhancing ink CL specified for this closest grid point is acquired (Step S325). Next, color change information, which is to be used for displaying a status of quality enhancing ink ejection on the image, is calculated on the basis of the acquired amount of the print quality-enhancing ink CL, and the original pixel data is corrected on the basis of this color change information (Step S330).

Figure 26:
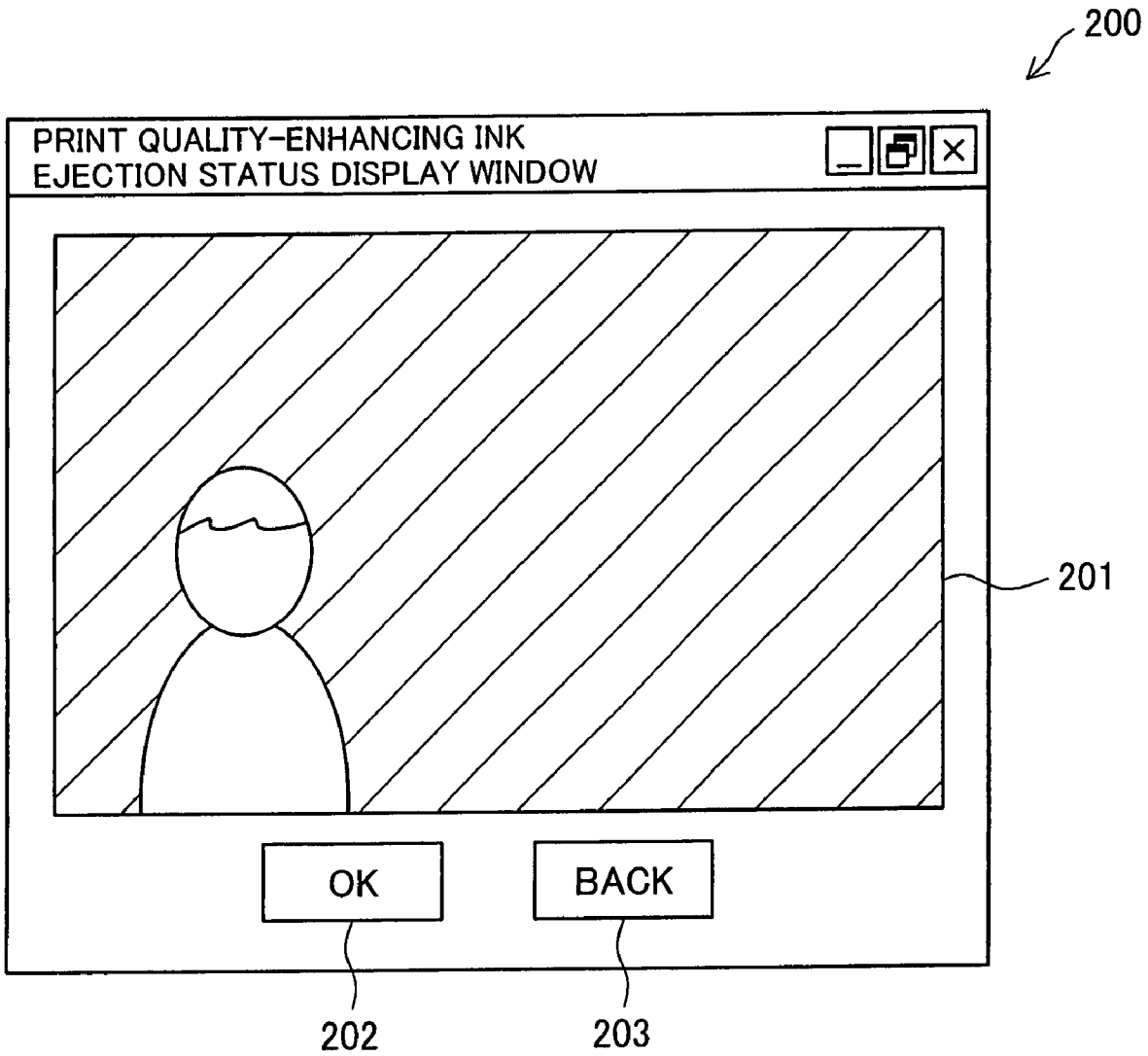
FIG. 26 is a screen shot of a print quality-enhancing ink ejection status display window.

For example, B (Blue) component of the pixel data may be increased on the basis of the amount of the print quality-enhancing ink CL, so as to produce blue gradation depending on the ejection amount of print quality-enhancing ink CL. The above process is performed on all pixels to modify the image data (Step S335). Next, the modified image data is displayed on the quality-enhancing ink ejection status display window shown in FIG. 26 (Step S340). The window 200 is provided with the modified image 201. Areas onto which print quality-enhancing ink CL will be ejected are displayed as hatched areas in FIG. 26, where blue gradation will be produced. By observing the state of gradation the user can visually confirm the ejection status of the print quality-enhancing ink CL. The user may accept the ejection status by clicking the OK button 202.

If, on the other hand, the user does not find the ejection status acceptable, he or she may click the Cancel button 203. In other words, when any button is clicked on the window 200, a determination is made as to whether the OK button 202 has been clicked (Step S345). If it is determined that the OK button 202 has been clicked, the system proceeds to Step S140 and subsequent steps. If, on the other hand, it is not determined that the OK button 202 has been clicked, i.e. that the Cancel button 203 has been clicked, the system returns to Step S120, allowing the user to correct the settings of the print quality-enhancing ink CL. In the embodiment described hereinabove, there is employed a method of inputting original image data and then determining whether RGB components of the image data for each pixel are of grid points on the color conversion table, but it would of course be possible to instead first convert the original image data to data on grid points, and then acquire print quality-enhancing ink CL data for each grid point.

In the second embodiment described hereinabove, when the user designates ejection characteristics of the print quality-enhancing ink CL on the window 100 (FIG. 22), the desired ejection amount of the print quality-enhancing ink CL can be designated by modifying the graph or ejection characteristic curve on the window. However, the method for designating ejection characteristic curve of the quality enhancing ink is not limited to this. In one example, a plurality of ejection characteristic selection patterns are prepared in advance, and a print may be made to reproduce these ejection characteristic selection patterns. The user can select a desired ejection characteristic selection pattern. The ejection amount of the print quality-enhancing ink CL in the first or second color conversion table 202*a* or 202*b* may be corrected on the basis of the selected ejection characteristic selection pattern.

Figure 27:
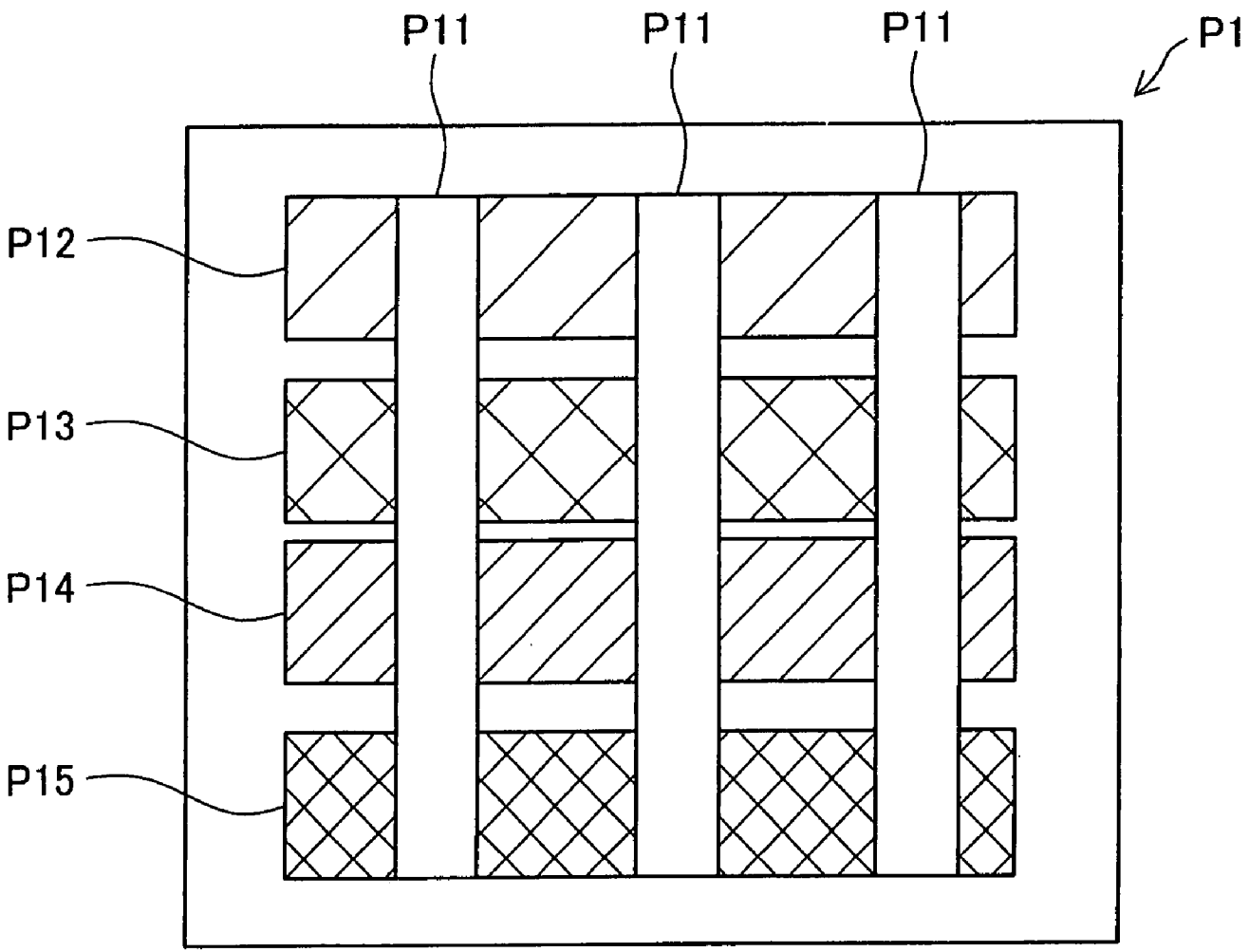
FIG. 27 shows an arrangement of a pattern printout.
Figure 28:
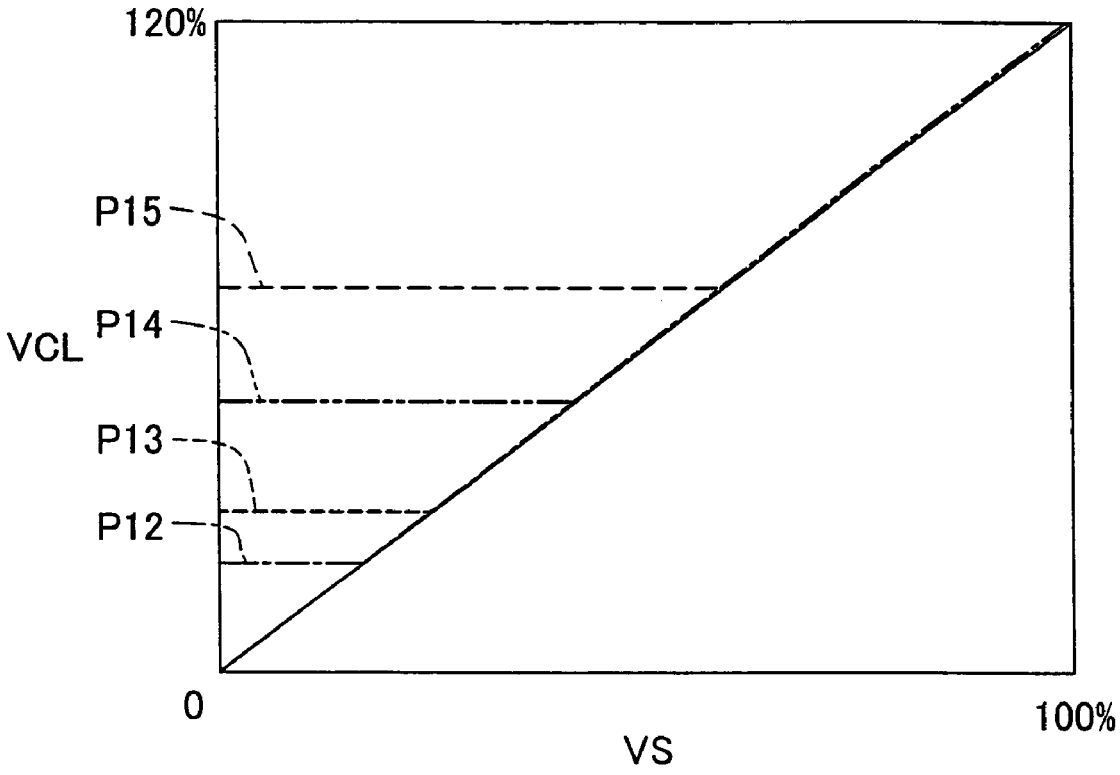
FIG. 28 shows the ink amounts for the printout patterns of FIG. 27.

FIG. 27 shows a pattern printout on which ejection characteristic selection patterns have been printed. Pattern printout P1 in the drawing is composed of C (cyan) areas P11 printed with a uniform amount of cyan ink, and print quality-enhancing ink areas P12–P15 printed while sequentially increasing the amount of the print quality-enhancing ink CL. In the second embodiment, the amount of the print quality-enhancing ink CL increases sequentially from area P12 towards area P15. The amount of the quality-enhancing ink CL in these areas P12–P15 are predefined by the ejection characteristic curves shown in FIG. 28. Curves P12–P15 in FIG. 28 correspond to the areas P12–P15 in FIG. 27. From the pattern printout P1 the user selects one of the area P12–P15 which has a level of gloss close to the gloss level of the Cyan area P11, this selection being presented to the ejection characteristic designation receiver 204 from an interface window (not shown) so that first or second color conversion table 202*a* or 202*b* is modified on the basis of the corresponding print characteristic curves P12–P15. In this way, the image will be printed using the quality-enhancing ink CL on the basis of the modified first or second color conversion table 202*a* or 202*b*.

Figure 29:
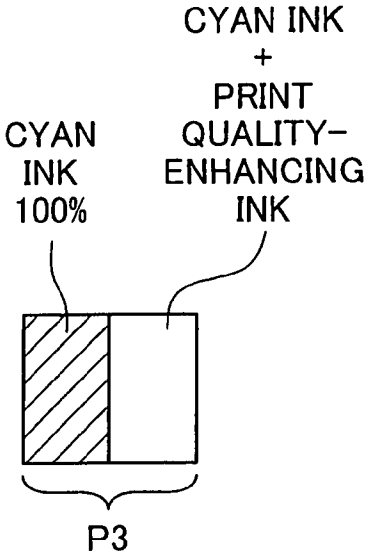
FIG. 29 shows another arrangement of a pattern printout.
Figure 30:
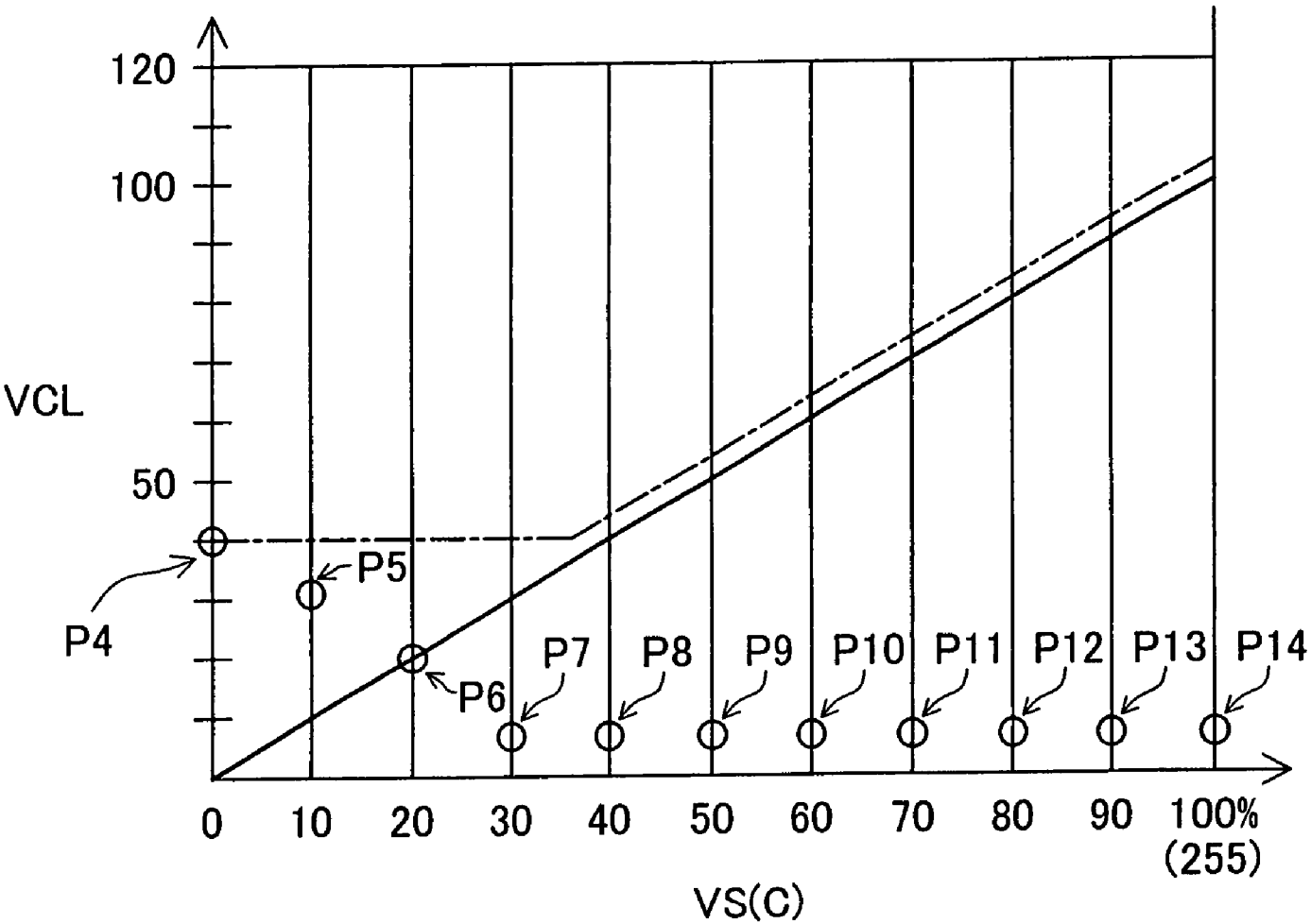
FIG. 30 shows the ink amounts for the printout patterns of FIG. 29.

FIG. 29 shows another arrangement for the pattern printout. The pattern printout P2 is composed of a multitude of approximately rectangular printed patches P3. Each patch P3 is divided to a left half area where cyan ink is ejected at the maximum amount of 100%, and a right half area where cyan ink C and quality-enhancing ink CL are ejected in predetermined amounts. The amount of print quality-enhancing ink CL in the patches increases going from left to right in the drawing (i.e., going from the left edge, 5%, 10%, 15%, 20%, 25%, 30%, 35%, 40%). The amount of cyan ink C in patches increases going from top to bottom in the drawing (i.e., going from the top edge, 0%, 10%, 20%, 30%, 40%, 50%, 60%, 70%, 80%, 90%). For each increment in cyan ink C the user selects a desired patch whose two divisional areas have similar gloss. This pattern selection designates the ejection amount VCL of the quality enhancing ink associated with the ejection amount VS of colored ink (in this case, cyan ink C) in FIG. 30. This designation is supplied to the ejection characteristic designation receiver 204, and the first or second color conversion table 202*a* or 202*b* is modified on the basis of this designation.

Figure 31:
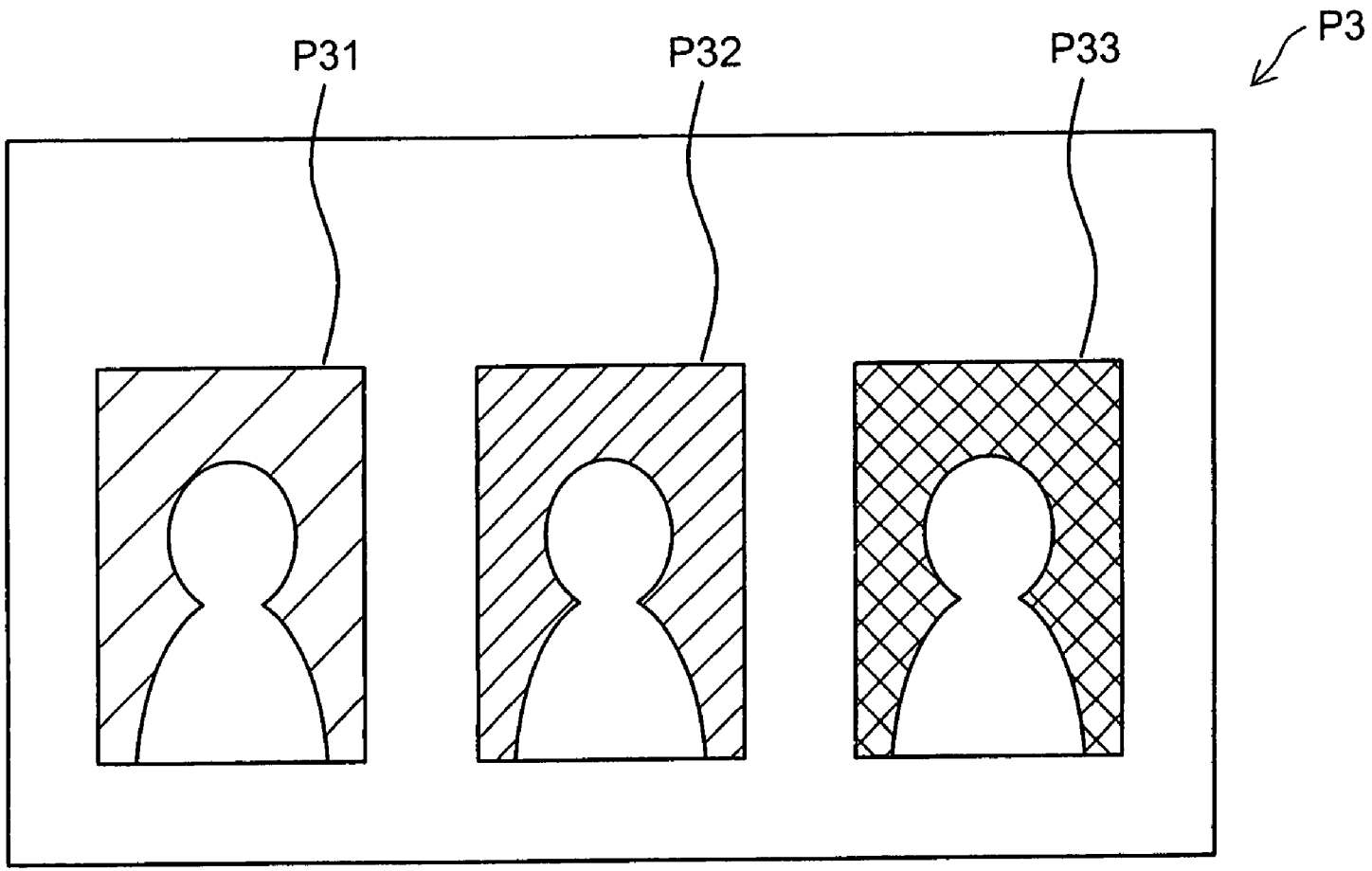
FIG. 31 shows another arrangement of a pattern printout.
Figure 32:
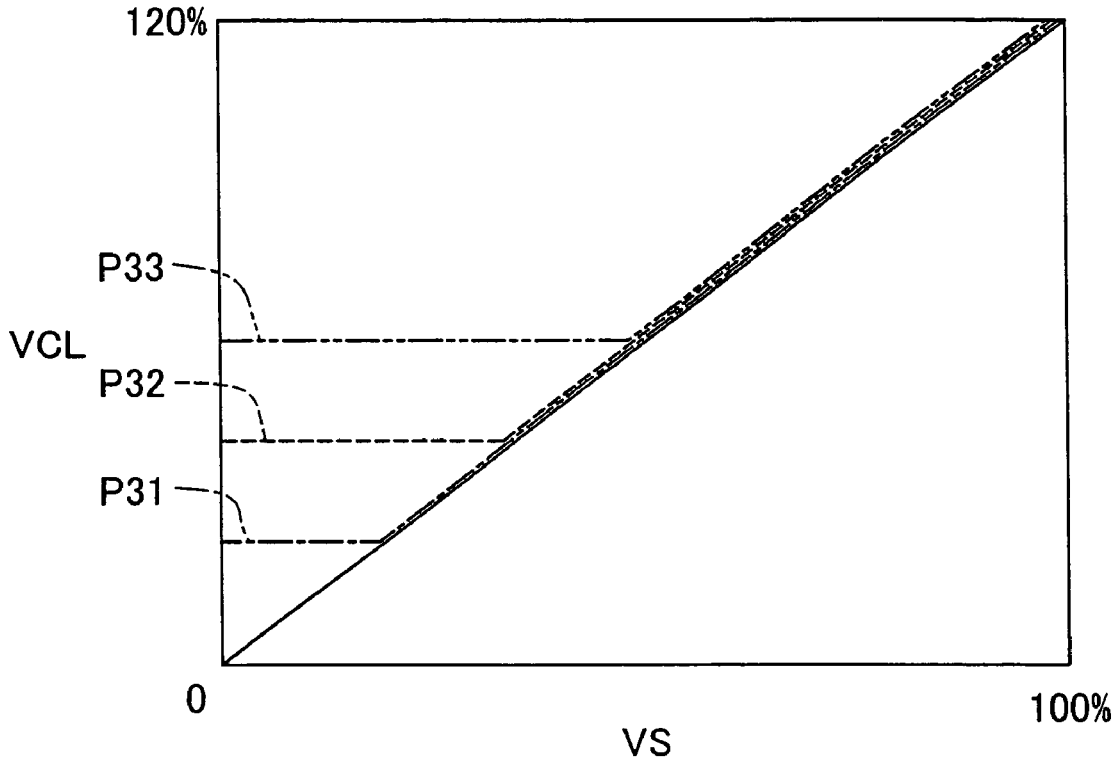
FIG. 32 shows the ink amounts for the printout patterns of FIG. 31.

FIG. 31 shows yet another arrangement for the pattern printout. The pattern printout P3 is composed of a first image pattern P31, a second image pattern P32, and a third image pattern P33. The first image patterns P31–P33 are printed with ejection characteristic curves P31–P33 shown in FIG. 32, respectively. The user selects any of the image patterns which has a level of gloss that does not contrast unattractively. The first or second color conversion table 202*a* or 202*b* is then modified by means of the ejection characteristic curve corresponding to the selected image pattern. In this way, the image is printed on the basis of the modified first or second color conversion table 202*a* or 202*b*.

Figure 33:
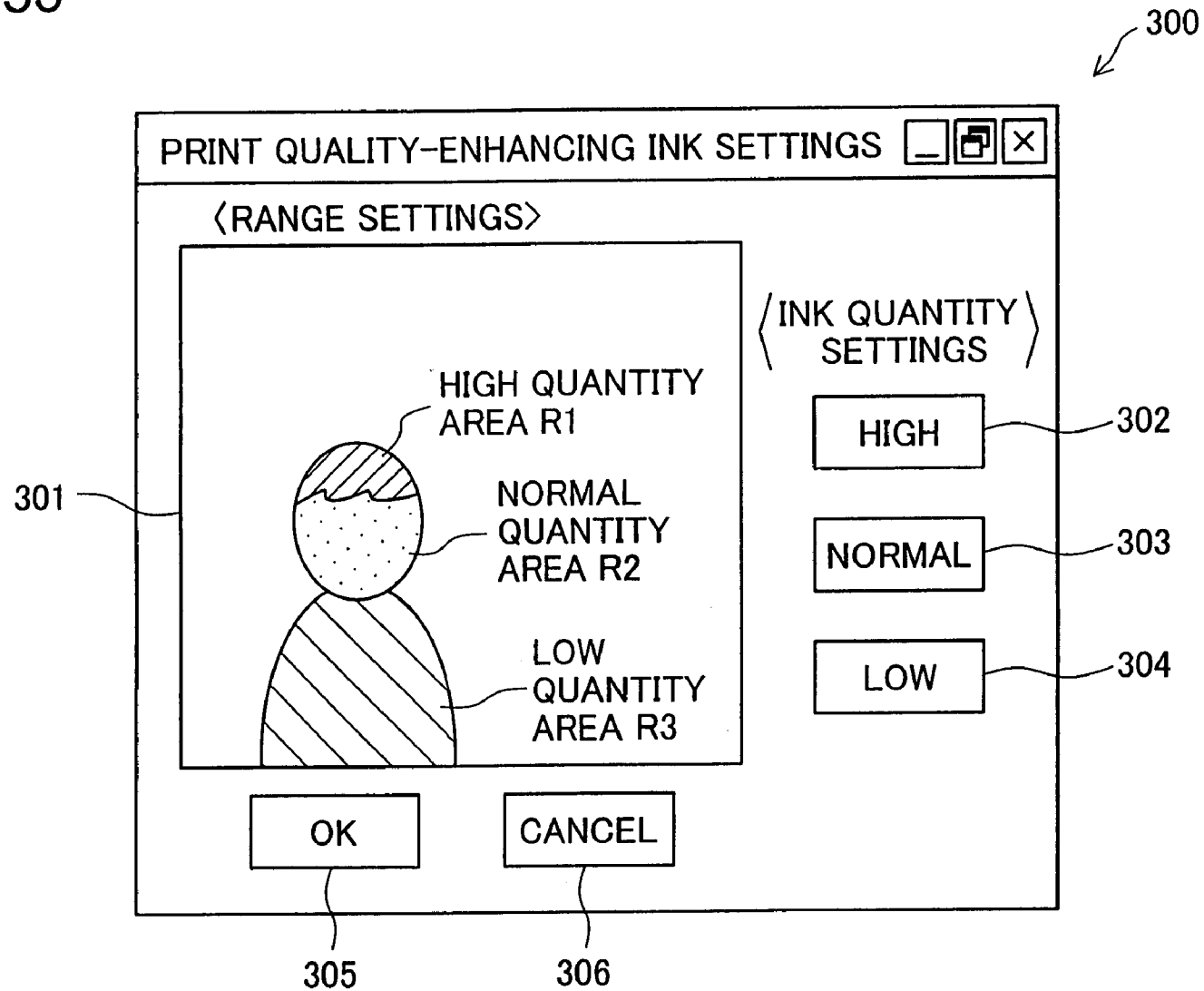
FIG. 33 is a screen shot showing a print quality-enhancing ink setting window arrangement.

In the second embodiments described hereinabove, there is employed an arrangement wherein ejection characteristics of the print quality-enhancing ink CL are designated by modifying an ejection characteristic curve of the print quality-enhancing ink CL, or wherein the ejection characteristics are designated using a pattern printout P1, P2, or P3. However, the method for designating ejection characteristics of the print quality-enhancing ink CL is not limited to these methods. Yet another method for designating ejection characteristics of the print quality-enhancing ink CL is now described. FIG. 33 is a screen shot showing a print quality-enhancing ink setting window which may be used to designate ejection characteristics of the print quality-enhancing ink CL. The window 300 includes a range setting image 301, a high ink quantity setting button 302, a normal ink quantity setting button 303, a low ink quantity setting button 304, an OK button 305, and a Cancel button 306. On the range setting image 301 in the window 300 the user may define areas where the print quality-enhancing ink CL is to be ejected using a mouse or other input device. In this process, ejection amount of the enhancing ink is set for each desired area with the buttons 302–304.

Figure 34:
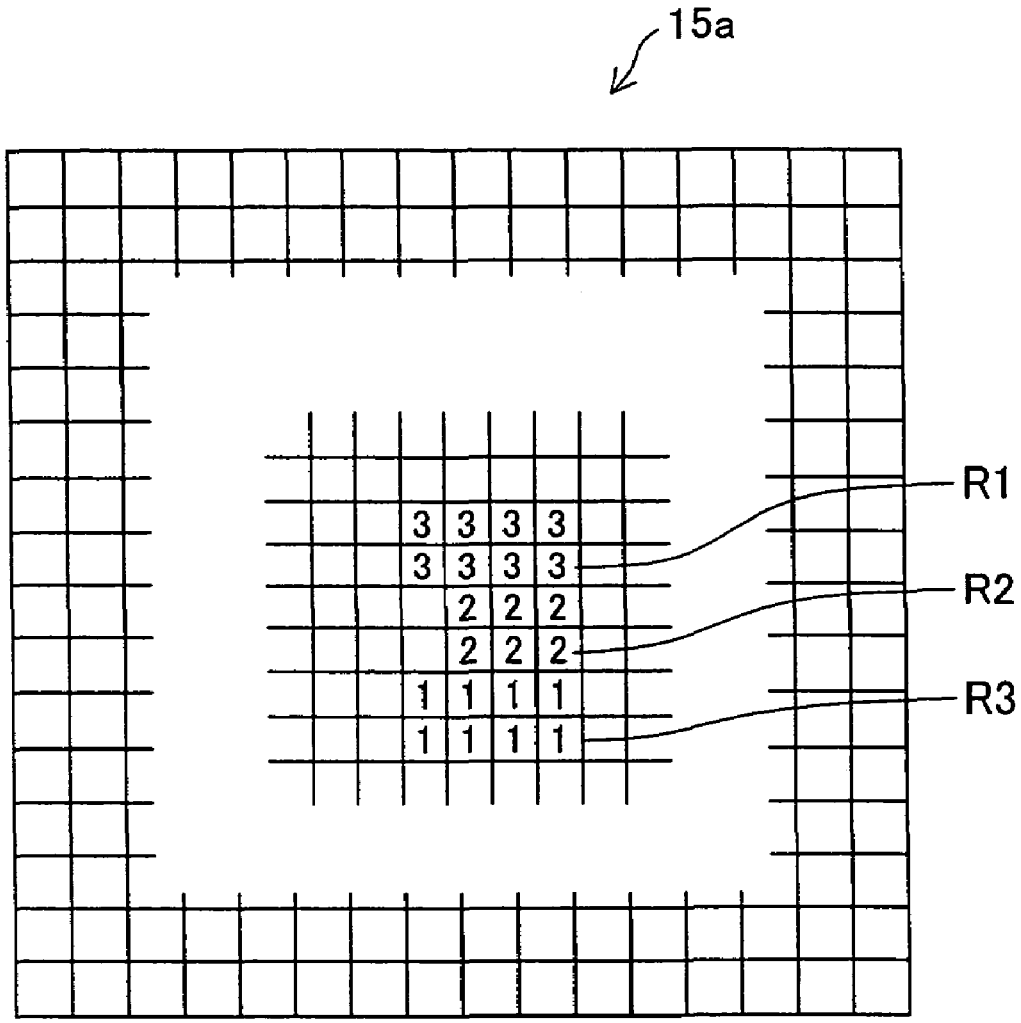
FIG. 34 shows the arrangement of image data.

In FIG. 33, high quantity area R1 is an area for which the high ink quantity setting button 302 is selected; normal quantity area R2 is an area for which the normal ink quantity setting button 303 is selected; and low quantity area R3 is an area for which the low ink quantity setting button 304 is selected. After completing designation of an area, the user clicks the OK button 305. The Cancel button 306 may be clicked to cancel a selection. FIG. 34 shows the result of the user's designation where a flag value 3 is set for pixels in the high quantity area R1, a flag value 2 in the normal quantity area R2, and a flag value 1 in the low quantity area R3. The appropriate first or second color conversion table 202*a* or 202*b* is corrected with reference to this designated flag status, and color conversion is performed.

Figure 35:
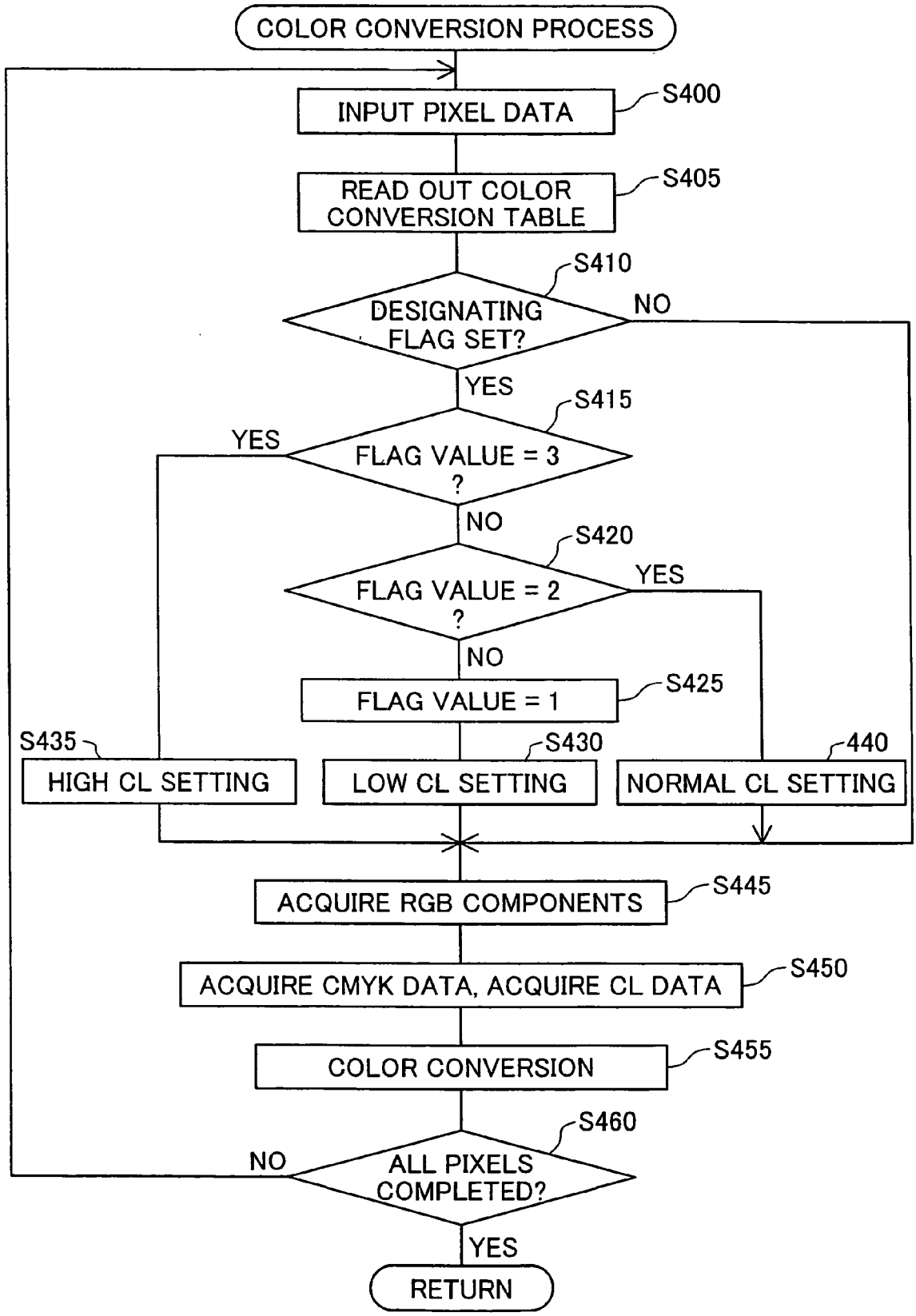
FIG. 35 is a flow chart illustrating the color conversion process.

FIG. 35 is a flow chart illustrating the color conversion process. The first step is inputting pixel data (Step S400). Next, depending on the type of print medium selected, either the first or second color conversion table 202*a* or 202*b* is read out (Step S405). It is then determined whether a designating flag has been set for the pixel data read out in Step S400 (Step S410). If it is determined that a flag value has been set, it is then determined whether the flag value equals 3 (Step S415). If the flag value equals 3, a large ejection amount is set for the print quality-enhancing ink CL (Step S435). If the flag value equals 2, a normal ejection amount is set (Step S440).

If the flag value equals 1 (Step S425), a low ejection amount is set (Step S430). At this point the RGB components are acquired from the pixel data input in Step S400 (Step S445), CMYK data is acquired from the first or second color conversion table 202*a* or 202*b* on the basis of this RGB components, and the ejection amount of the print quality-enhancing ink CL is acquired and appended to the CMYK data. Alternatively, the ejection amount of the print quality-enhancing ink CL obtained with the original first or second color conversion table 202*a* or 202*b* may be corrected on the basis of the designated ejection characteristics in Step S450. Color conversion is thus completed to obtain the acquired CMYK data and the amount of the print quality-enhancing ink CL (Step S455). The above process is performed for all pixels (Step S460).

In the second embodiment described above, the ejection amount of the print quality-enhancing ink CL can be modified appropriately depending on the image to be printed or type of print medium used, by means of a print quality-enhancing ink adjustment window 100 (FIG. 22), pattern printouts P1–P3 (FIG. 27), print quality-enhancing ink setting window 300 (FIG. 33), and so on. The enhancing ink amount data in a first or second color conversion table 202*a* or 202*b* is modified accordingly, thereby attaining desired ejection characteristics of the print quality-enhancing ink CL to improve print quality.

D. Variants

D1. Variant 1

The printer driver 96 may be constructed to selectively run the first quality adjusting mode (first paper mode) and second quality adjusting mode (second paper mode), or may be constructed to run only one quality adjusting mode. Use of the printer driver which can selectively run the first and second quality adjusting modes will allow uneven gloss and uneven color development to be improved with only one type of quality enhancing ink. Furthermore, the first and second quality adjusting modes may each be composed of a plurality of sub modes. Preparing a plurality of sub modes in this manner will allow user desires to be addressed in greater detail and will enhance convenience. Furthermore, when a plurality of sub modes can be used, a plurality of look-up tables may be prepared for the plurality of sub modes, respectively. This will enable more rapid printing with selected adjusting mode.

D2. Variant 2

The ejection amount of quality enhancing ink can be adjusted on the basis of the amount of one or some of the available colored inks instead of the total amount of all of the colored inks. For example, in the first quality adjusting mode, each of the colored inks can be ejected to compare gloss, and the amount of quality enhancing ink can be adjusted on the basis of the ejection amount of colored ink(s) with relatively high gloss. Specifically, the amount of quality enhancing ink can be determined based on the total ejection amount of K, C, M, and Y inks, excluding light cyan ink LC and light magenta ink LM, to improve uneven gloss.

D3. Variant 3

Ink for reducing gloss of ejected colored ink can be used as the enhancing ink. In this case, the second quality adjusting mode can be used to improve uneven gloss in print images. The ejection amount of enhancing ink VCL is set so that a value VCL for the colored ink amount VS of about 0% is lower than a value VCL for the VS value of about 100%. The gloss in areas where greater amounts of colored ink are ejected can thus be reduced by the quality enhancing ink to minimize the difference in gloss from areas where lower amounts of colored ink are ejected. In areas where low amounts of colored ink are ejected, the amount of enhancing ink that is ejected can be reduced so that enhancing ink is not ejected more than is necessary. The quality enhancing ink can thus be conserved.

D4. Variant 4

The amount of enhancing ink can be modified stepwise over a plurality of steps rather than being continuously modified according to the amounts of other ink. This can simplify the control of the amount of enhancing ink.

D5. Variant 5

In the above examples, printing is accomplished using look-up tables, but the present invention is also applicable to printing methods and printing devices which do not involve the use of such look-up tables.

D6. Variant 6

The present invention is also applicable to drum scan printers. The present invention is applicable to not just what are referred to as ink jet printers, but also to printing devices in which images are generally printed by the ejection of ink from a print head. Examples of such printing devices include facsimile devices and copy machines.

D7. Variant 7

In the above examples, portions of the structure realized by hardware may be replaced by software. Conversely, portions of the structure realized by software may be replaced by hardware. For example, part of the function of the printer driver 96 (FIG. 1) can be designed to be run by the control circuit 40 (FIG. 3) in the printer 20.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A printing control device for generating print data from image data, the print data representing an ink ejection state at each pixel of a print image, the ink ejection state including an ejection amount of colored ink containing colorant and an ejection amount of quality enhancing ink for improving image quality of the print image, the printing control device comprising:

ejection characteristic designation receiving means for receiving an ejection characteristic designation that specifies ejection characteristics of the quality enhancing ink from a user, wherein the ejection characteristic designation excludes a print medium, a temperature, and a print mode;

ejection characteristics modifying means for modifying the ejection amount of the quality enhancing ink on the basis of the received ejection characteristic designation; and print data generating means for generating print data representing the ink ejection state including the ejection amount of the colored ink and the modified ejection amount of the quality enhancing ink at each pixel of the print image.

2. A printing control device according to claim 1, wherein the ejection characteristic designation receiving means receives the ejection amount of the quality enhancing ink as a function of the ejection amount of the colored ink.

3. A printing control device for generating print data from image data, the print data representing an ink ejection state at each pixel of a print image, the ink ejection state including an ejection amount of colored ink containing colorant and an ejection amount of quality enhancing ink for improving image quality of the print image, the printing control device comprising:

ejection characteristic designation receiving means for receiving an ejection characteristic designation that specifies ejection characteristics of the quality enhancing ink;

ejection characteristics modifying means for modifying the ejection amount of the quality enhancing ink on the basis of the received ejection characteristic destination;

print data generating means for generating print data representing the ink ejection state including the ejection amount of the colored ink and the modified ejection amount of the quality enhancing ink at each pixel of the print image, wherein the ejection characteristic designation receiving means receives the ejection amount of the quality enhancing ink as a function of the ejection amount of the colored ink;

relationship display means for displaying a relationship between the ejection amount of the colored ink and the ejection amount of the quality enhancing ink; and designating means for designating the modified ejection amount of the quality enhancing ink on the display of the relationship, wherein the ejection characteristic designation receiving means receives the designation of the modified ejection amount from the designating means.

4. A printing control device according to claim 3, wherein the ejection characteristic designation receiving means comprises print medium selection receiving means that receives a selection indicating whether a print medium to be used is a relatively high gloss print medium or a relatively low gloss print medium, and the relationship display means displays the relationship that differs depending on the print medium to be used.

5. A printing control device for generating print data from image data, the print data representing an ink ejection state at each pixel of a print image, the ink ejection state including an ejection amount of colored ink containing colorant and an ejection amount of quality enhancing ink for improving image quality of the print image, the printing control device comprising:

ejection characteristic designation receiving means for receiving an ejection characteristic designation that specifies ejection characteristics of the quality enhancing ink;

ejection characteristics modifying means for modifying the ejection amount of the quality enhancing the basis of the received election characteristic designation;

print data generating means for generating print data representing the ink ejection state including the ejection amount of the colored ink and the modified ejection amount of the quality enhancing ink at each pixel of the print image; and ejection area displaying means for visually displaying a quality enhancing ink ejection area of the print image in which the quality enhancing ink is to be ejected, based on the ejection characteristic designation received by the ejection characteristic designation receiving means.

6. A printing control device according to claim 5, wherein the ejection area displaying means visually displays a magnitude of the ejection amount of the quality enhancing ink in the quality enhancing ink ejection area.

7. A printing control device for generating print data from image data, the print data representing an ink ejection state at each pixel of a print image, the ink ejection state including an ejection amount of colored ink containing colorant and an ejection amount of quality enhancing ink for improving image quality of the print image, the printing control device comprising:

ejection characteristic designation receiving means for receiving an ejection characteristic designation that specifies ejection characteristics of the quality enhancing ink;

ejection characteristics modifying means for modifying the ejection amount of the quality enhancing ink on the basis of the received characteristic designation; and print data generating means for generating print data representing the ink ejection state including the ejection amount of the colored ink and the modified ejection amount of the quality enhancing ink at each pixel of the print image, wherein the ejection characteristic designation receiving means displays a preview image based on the image data, and receives as the ejection characteristic designation an area specified on the preview image in which the quality enhancing ink is to be ejected.

8. A printing control device according to claim 7, wherein the ejection characteristic designation receiving means is able to receive a plurality of areas having different ejection amounts of the quality enhancing ink.

9. A printing control device according to claim 8, wherein the ejection characteristics modifying means modifies the ejection amount of the quality enhancing ink such that a fixed amount of the quality enhancing ink is ejected within each area specified by the ejection characteristic designation.

10. A printing control device according to claim 8, wherein the ejection characteristics modifying means comprises colored ink ejection amount acquiring means for acquiring an ejection amount of the colored ink at each pixel in the quality enhancing ink ejection area, and wherein the ejection amount of the quality enhancing ink is modified on an individual pixel basis as a function of the colored ink ejection amount acquired by the colored ink ejection amount acquiring means.

11. A printing control device for generating print data from image data, the print data representing an ink ejection state at each pixel of a print image, the ink ejection state including an ejection amount of colored ink containing colorant and an ejection amount of quality enhancing ink for improving image quality of the print image, the printing control device comprising:

ejection characteristic designation receiving means for receiving an ejection characteristic designation that specifies ejection characteristics of the quality enhancing ink;

ejection characteristics modifying means for modifying the ejection amount of the quality enhancing ink on the basis of the received ejection characteristic designation;

print data generating means for generating print data representing the ink ejection state including the ejection amount of the colored ink and the modified ejection amount of the quality enhancing ink at each pixel of the print image; and pattern print data generating means for generating pattern print data that represent an ejection characteristic designation pattern for use in designating the ejection characteristics, wherein the ejection characteristic designation pattern is printed by a printing device on the basis of the generated pattern print data, and wherein the ejection characteristic designation receiving means receives the ejection characteristic designation based on the printed ejection characteristic designation pattern, and the ejection characteristics modifying means modifies the ejection amount of the quality enhancing ink on the basis of the received ejection characteristic designation.

12. A printing control device according to claim 11 wherein the pattern print data generating means generates the pattern print data that includes:

(i) a colored ink area to be produced by ejecting a fixed amount of the colored ink, and (ii) quality enhancing ink areas to be produced by ejecting different ejection amounts of the quality enhancing ink, respectively, the quality enhancing ink areas being arranged adjacent to the colored ink area, wherein the pattern print data causes the printing device to print the ejection characteristic designation pattern, and wherein the ejection characteristic designation receiving means receives as the ejection characteristic designation the quality enhancing ink ejection amount used for producing a selected one among the plurality of quality enhancing ink areas.

13. A printing control device according to claim 11 wherein the pattern print data generating means generates the pattern print data representing a plurality of patches each having a fixed amount of the colored ink and a fixed amount of the quality enhancing ink while the plurality of patches are different in the fixed amounts of the inks, wherein the pattern print data causing the printing device to print the patches arranged adjacent to each other, and wherein the ejection characteristic designation receiving means receives as the ejection characteristic designation the fixed amounts of the inks used for producing a selected one among the plurality of patches.

14. A printing control device according to claim 11, wherein the pattern print data generating means generates the pattern print data representing a plurality of sample images that are associated with different relationships of the colored ink amount and the quality enhancing ink amount, respectively, and wherein the pattern print data causes the printing device to print the plurality of sample images, and wherein the ejection characteristic designation receiving means receives as the ejection characteristic designation a relationship of the colored ink amount and the quality enhancing ink amount used for producing a selected one among the plurality of sample images.

15. A printing control device for generating print data from image data, the print data representing an ink ejection state at each pixel of a print image, the ink ejection state including an ejection amount of colored ink containing colorant and an ejection amount of quality enhancing ink for improving image qualit of the print image the printing control device comprising:

ejection characteristic designation receiving means for receiving an ejection characteristic designation that specifies ejection characteristics of the quality enhancing ink;

ejection characteristics modifying means for modifying the ejection amount of the quality enhancing ink on the basis of the received election characteristic designation;

print data generating means for generating print data representing the ink ejection state including the ejection amount of the colored ink and the modified ejection amount of the quality enhancing ink at each pixel of the print image; and a color conversion table that specifies relationships between gradation values of color components of the image data and ejection amounts of the colored ink and quality enhancing ink, wherein the ejection characteristics modifying means corrects the color conversion table to attain the modifying of the ejection amount of the quality enhancing ink, and wherein the print data generating means uses the corrected color conversion table to generate the print data.

16. A method for generating print data from image data, the print data representing an ink ejection state at each pixel of a print image, the ink ejection state including an ejection amount of colored ink containing colorant and an ejection amount of quality enhancing ink for improving image quality of the print image, the method comprising the steps of:

(a) receiving an ejection characteristic designation that specifies ejection characteristics of the quality enhancing ink from a user, wherein the ejection characteristic designation excludes a print medium, a temperature, and a print mode;

(b) modifying the ejection amount of the quality enhancing ink on the basis of the received ejection characteristic designation; and (c) generating print data representing the ink ejection state including the ejection amount of the colored ink and the modified ejection amount of the quality enhancing ink at each pixel of the print image.

17. A method according to claim 16, wherein the step (a) includes receiving the ejection amount of the quality enhancing ink as a function of the ejection amount of the colored ink.

18. A method for generating print data from image data, the print data representing an ink ejection state at each pixel of a print image, the ink ejection state including an ejection amount of colored ink containing colorant and an ejection amount of quality enhancing ink for improving image quality of the print image, the method comprising:

(a) receiving an ejection characteristic designation that specifies ejection characteristics of the quality;

(b) modifying the ejection amount of the quality enhancing ink on the basis of the received ejection characteristic designation;

(c) generating print data representing the ink ejection state including the ejection amount of the colored ink and the modified ejection amount of the quality enhancing ink at each pixel of the print image, wherein the step (a) comprises receiving the ejection amount of the quality enhancing ink as a function of the ejection amount of the colored ink;

(d) displaying a relationship between the ejection amount of the colored ink and the ejection amount of the quality enhancing ink; and (e) designating the modified ejection amount of the quality enhancing ink on the display of the relationship, wherein the step (a) includes receiving the designation of the modified ejection amount designated in the step (e).

19. A method according to claim 18, wherein the step (a) comprises receiving a selection indicating whether a print medium to be used is a relatively high gloss print medium or a relatively low gloss print medium, and the step (d) displays the relationship that differs depending on the print medium to be used.

20. A method for generating print data from image data, the print data representing an ink ejection state at each pixel of a print image, the ink ejection state including an ejection amount of colored ink containing colorant and an ejection amount of quality enhancing ink for improving image quality of the print image, the method comprising:

(a) receiving an ejection characteristic designation that specifies ejection characterstics of the quality enhancing ink;

(b) modifying the ejection amount of the quality enhancing ink on the basis of the received ejection characteristic designation;

(c) generating print data representing the ink ejection state including the ejection amount of the colored ink and the modified election amount of the quality enhancing ink at each pixel of the print image; and (d) visually displaying a quality enhancing ink ejection area of the print image in which the quality enhancing ink is to be ejected, based on the ejection characteristic designation received in the step (a).

21. A method according to claim 20, wherein the step (d) includes visually displaying a magnitude of the ejection amount of the quality enhancing ink in the quality enhancing ink ejection area.

22. A method for generating print data from image data, the print data representing an ink ejection state at each pixel of a print image, the ink ejection state including an ejection amount of colored ink containing colorant and an election amount of quality enhancing ink for improving image quality of the print image, the method comprising:

(a) receiving an ejection characteristic designation that specifies ejection characterstics of the quality enhancing ink;

(b) modifying the ejection amount of the quality enhancing ink on the basis of the received ejection characteristic designation; and (c) generating print data representing the ink ejection state including the ejection amount of the colored ink and the modified ejection amount of the quality enhancing ink at each pixel of the print image.

wherein the step (a) includes displaying a preview image based on the image data, and receiving as the ejection characteristic designation an area specified on the preview image in which the quality enhancing ink is to be ejected.

23. A method according to claim 22, wherein the step (a) includes receiving a plurality of areas having different ejection amounts of the quality enhancing ink.

24. A method according to claim 23, wherein the step (b) includes modifying the ejection amount of the quality enhancing ink such that a fixed amount of the quality enhancing ink is ejected within each area specified by the ejection characteristic designation.

25. A method according to claim 23, wherein the step (b) includes acquiring an ejection amount of the colored ink at each pixel in the quality enhancing ink ejection area, and wherein the ejection amount of the quality enhancing ink is modified on an individual pixel basis as a function of the acquired colored ink ejection amount.

26. A method for generating print data from image data, the print data representing an ink ejection state at each pixel of a print image, the ink ejection state including an ejection amount of colored ink containing colorant and an ejection amount of quality enhancing ink for improving image quality of the print image, the method comprising:

(a) receiving an ejection characteristic designation that specifies ejection characteristics of the quality enhancing ink;

(b) modifying the ejection amount of the quality enhancing ink on the basis of the received ejection characteristic designation;

(c) generating print data representing the ink ejection state including the ejection amount of the colored ink and the modified ejection amount of the quality enhancing ink at each pixel of the print image;

generating pattern print data that represent an ejection characteristic designation pattern for use in designating the ejection characteristics, and printing the ejection characteristic designation pattern according to the generated pattern print data, wherein the step (a) includes receiving the ejection characteristic designation based on the printed ejection characteristic designation pattern, and the step (b) includes modifying the ejection amount of the quality enhancing ink on the basis of the received ejection characteristic designation.

27. A method according to claim 26 wherein the pattern print data that includes:

(i) a colored ink area to be produced by ejecting a fixed amount of the colored ink, and (ii) quality enhancing ink areas to be produced by ejecting different ejection amounts of the quality enhancing ink, respectively, the quality enhancing ink areas being arranged adjacent to the colored ink area, wherein the step of printing the ejection characteristic designation pattern includes printing the ejection characteristic designation pattern, and wherein the step (a) includes receiving as the ejection characteristic designation the quality enhancing ink ejection amount used for producing a selected one among the plurality of quality enhancing ink areas.

28. A method according to claim 26 wherein the pattern print data represent a plurality of patches each having a fixed amount of the colored ink and a fixed amount of the quality enhancing ink while the plurality of patches are different in the fixed amounts of the inks, wherein the step of printing the ejection characteristic designation pattern includes printing the patches arranged adjacent to each other, and wherein the step (a) includes receiving as the ejection characteristic designation the fixed amounts of the inks used for producing a selected one among the plurality of patches.

29. A method according to claim 26, wherein the pattern print data represent a plurality of sample images that are associated with different relationships of the colored ink amount and the quality enhancing ink amount, respectively, and wherein the step of printing the ejection characteristic designation pattern includes printing the plurality of sample images, and wherein the step (a) includes receiving as the ejection characteristic designation a relationship of the colored ink amount and the quality enhancing ink amount used for producing a selected one among the plurality of sample images.

30. A method for generating print data from image data, the print data representing an ink ejection state at each pixel of a print image, the ink ejection state including an ejection amount of colored ink containing colorant and an ejection amount of quality enhancing ink for improving image quality of the print image, the method comprising:

(a) receiving an ejection characteristic designation that specifies ejection characteristics of the quality enhancing ink;

(b) modifying the ejection amount of the quality enhancing ink on the basis of the received ejection characteristic designation;

(c) generating print data representing the ink ejection state including the ejection amount of the colored ink and the modified election amount of the quality enhancing ink at each pixel of the print image; and providing a color conversion table that specifies relationships between gradation values of color components of the image data and ejection amounts of the colored ink and quality enhancing ink, wherein the step (b) includes correcting the color conversion table to attain the modifying of the ejection amount of the quality enhancing ink, and wherein the step (c) includes using the corrected color conversion table to generate the print data.

31. A computer readable medium storing a computer program for generating print data from image data, the print data representing an ink ejection state at each pixel of a print image, the ink ejection state including an ejection amount of colored ink containing colorant and an ejection amount of quality enhancing ink for improving image quality of the print image, the computer program including:

a first program for causing a computer to receive an ejection characteristic designation that specifies ejection characteristics of the quality enhancing ink from a user, wherein the ejection characteristic designation excludes a print medium, a temperature, and a print mode;

a second program for causing the computer to modify the ejection amount of the quality enhancing ink on the basis of the received ejection characteristic designation; and a third program for causing the computer to generate print data representing the ink ejection state including the ejection amount of the colored ink and the modified ejection amount of the quality enhancing ink at each pixel of the print image.

* * * * *